US009703228B2

(12) United States Patent
Seki

(10) Patent No.: US 9,703,228 B2
(45) Date of Patent: Jul. 11, 2017

(54) TIMING ADJUSTMENT OF MULTI-BEAM IMAGE FORMING APPARATUS

(71) Applicant: CANON KABUSHIKI KAISHA, Tokyo (JP)

(72) Inventor: Hirotaka Seki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 272 days.

(21) Appl. No.: 14/445,954

(22) Filed: Jul. 29, 2014

(65) Prior Publication Data

US 2015/0042739 A1 Feb. 12, 2015

(30) Foreign Application Priority Data

Aug. 8, 2013 (JP) ..... 2013-165586

(51) Int. Cl.

| | |
|---|---|
| ***B41J 2/435*** | (2006.01) |
| ***B41J 2/47*** | (2006.01) |
| ***G03G 15/043*** | (2006.01) |

(52) U.S. Cl.

CPC ..... *G03G 15/043* (2013.01)

(58) Field of Classification Search

CPC ..... B41J 2/47; B41J 2/435

USPC ..... 347/229, 234, 235, 248–250

See application file for complete search history.

(56) References Cited

U.S. PATENT DOCUMENTS

| | | | | |
|---|---|---|---|---|
| 5,532,794 | A | 7/1996 | Tokuyama et al. | 355/208 |
| 5,966,231 | A * | 10/1999 | Bush et al. | 359/204.1 |
| 8,334,887 | B2 * | 12/2012 | Gentner et al. | 347/235 |
| 2012/0287483 | A1 * | 11/2012 | Otoguro | G02B 26/128 358/475 |

FOREIGN PATENT DOCUMENTS

| | | |
|---|---|---|
| JP | H05-188697 | 7/1993 |
| JP | H05-313454 | 11/1993 |
| JP | H06-337595 | 12/1994 |

(Continued)

OTHER PUBLICATIONS

Office Action dated May 22, 2017 in counterpart Japan Application No. 2013-165586, together with machine-generated translation thereof.

*Primary Examiner* — Matthew Luu
*Assistant Examiner* — Patrick King
(74) *Attorney, Agent, or Firm* — Fitzpatrick, Cella, Harper & Scinto

(57) ABSTRACT

An image forming apparatus includes multiple light emitting elements (LDs) as a light source, controls the light source such that laser beams emitted from $LD_1$ and $LD_N$ are sequentially incident on a BD sensor in a non-image-forming period, and measures a time interval between two BD signals output sequentially from the BD sensor. When image formation is performed subsequent to the non-image-forming period, the image forming apparatus controls the light source such that a laser beam from the $LD_1$ is incident on the BD sensor. Furthermore, using a single BD signal output from the BD sensor as a reference, the image forming apparatus controls timings at which the LDs emit laser beams based on the image data, according to the measurement value of the time intervals between the BD signals.

12 Claims, 21 Drawing Sheets

(56) References Cited

FOREIGN PATENT DOCUMENTS

| | | | | |
|---|---|---|---|---|
| JP | 2008-089695 | | | 4/2008 |
| JP | 2008089695 | A | * | 4/2008 |
| JP | 2009-036905 | | | 2/2009 |
| JP | 2009-126110 | | | 6/2009 |

* cited by examiner

FIG. 18

1800

| REGISTER VALUE | SETTING VALUE(M) |
|---|---|
| 0 | 20 |
| 1 | 40 |
| 2 | 60 |
| 3 | 80 |
| 4 | 100 |
| ⋮ | ⋮ |

TIMING ADJUSTMENT OF MULTI-BEAM IMAGE FORMING APPARATUS

BACKGROUND OF THE INVENTION

Field of the Invention

The present invention relates to an electrophotographic image forming apparatus.

Description of the Related Art

Conventionally, image forming apparatuses are known which form electrostatic latent images on a photosensitive member by deflecting a light beam emitted from a light source using a rotating polygonal mirror and scanning the photosensitive member using the deflected light beam. This kind of image forming apparatus includes an optical sensor for detecting the light beam deflected by the rotating polygonal mirror (beam detection (BD) sensor), and the optical sensor generates a synchronization signal upon detecting the light beam. By causing the light beam to be emitted from the light source at a time that is determined using the synchronization signal generated by the optical sensor as a reference, the image forming apparatus keeps constant the writing start position for the electrostatic latent image (image) in the direction in which the light beam scans the photosensitive member (main scanning direction).

Also, image forming apparatuses are known which include multiple light emitting elements as light sources for emitting light beams that each scan different lines on the photosensitive member in parallel in order to realize a higher image formation speed and higher resolution images. With this kind of multi-beam image forming apparatus, a higher image formation speed is realized by scanning multiple lines in parallel using multiple light beams, and higher resolution images are realized by adjusting the interval between the lines in the sub-scanning direction.

Japanese Patent Laid-Open No. 2008-89695 discloses an image forming apparatus that includes multiple light emitting elements as a light source and is capable of adjusting the resolution in the sub-scanning direction by performing rotational adjustment of the light source in the plane in which the light emitting elements are arranged. This kind of resolution adjustment is performed in the step of assembling the image forming apparatus. The patent literature above discloses a technique for suppressing shifts in the writing start positions in the main scanning direction for the electrostatic latent image that occur due to light source attachment errors in the assembly step. Specifically, the image forming apparatus uses a BD sensor to detect light beams emitted from a first light emitting element and a second light emitting element and generates multiple BD signals. Furthermore, the image forming apparatus sets a light beam emission time for the second light emitting element relative to the light beam emission time for the first light emitting element based on the difference in the generation times of the generated BD signals. This compensates for the light source attachment error in the assembly step and suppresses shifts in the writing start positions for the electrostatic latent images between the light emitting elements.

However, with the optical scanning apparatus (image forming apparatus) including multiple light emitting elements as a light source, the following problem is present in the method for measuring the difference between the generation times of the BD signals generated by the BD sensor as described above.

During the execution of image formation, the overall temperature of the optical scanning apparatus rises due to heat generated from the polygon motor rotating the rotating polygonal mirror (polygon mirror) that deflects the beams, and the optical characteristics of the optical system, such as the refractive index of the lens, change. According to this, a shift occurs in the imaging positions on the photosensitive member of the light beams deflected by the polygon mirror, and therefore the result of measuring the difference in the generation times of the BD signals also changes. As a result, it may become impossible to align the writing start positions, in the main scanning direction, of the electrostatic latent images formed by the light beams emitted from the light emitting elements. Accordingly, in order to align the writing start positions, in the main scanning direction, of the electrostatic latent images formed by the light beams, it is necessary to control the times at which the light beams are emitted from the light emitting elements so as to follow the change in the temperature in the optical scanning apparatus while image formation is being executed.

SUMMARY OF THE INVENTION

The present invention has been made in view of the above-mentioned problem. The present invention in one aspect provides a technique of, in an image forming apparatus including multiple light emitting elements, controlling the times at which multiple light emitting elements emit multiple light beams based on image data with higher accuracy even if the temperature in the image forming apparatus changes while image formation is being executed.

According to one aspect of the present invention, there is provided an image forming apparatus comprising: a light source including a plurality of light emitting elements that each emit a light beam; a deflection unit configured to deflect a plurality of light beams emitted from the plurality of light emitting elements, such that the plurality of light beams scan a photosensitive member; an optical sensor, that is provided on a scanning path of a light beam deflected by the deflection unit, configured to output a detection signal that indicates that a light beam deflected by the deflection unit has been detected due to the light beam being incident on the optical sensor; a measurement unit configured to control the light source such that, in a non-image-forming period during which a region other than an image forming region on the photosensitive member is scanned, light beams from first and second light emitting elements among the plurality of light emitting elements are sequentially incident on the optical sensor, and to measure a time interval between two detection signals output sequentially from the optical sensor; and a control unit configured to, in an image forming period during which the image forming region is scanned and which is subsequent to the non-image-forming period, control the light source such that a light beam from the first light emitting element is incident on the optical sensor, and control, using one detection signal output from the optical sensor as a reference, emission times of light beams based on image data for the plurality of light emitting elements, according to a measurement value obtained by measurement performed by the measurement unit.

According to the present invention, in an image forming apparatus including multiple light emitting elements, the times at which multiple light emitting elements emit multiple light beams based on image data can be controlled with higher accuracy even if the temperature in the image forming apparatus changes while image formation is being executed.

Further features of the present invention will become apparent from the following description of exemplary embodiments with reference to the attached drawings.

BRIEF DESCRIPTION OF THE DRAWINGS

FIG. 18 is a diagram showing an example of a setting value M for the execution timing of BD interval measurement (mode 2) according to Embodiment 2.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

The following describes an exemplary case in which the present invention has been applied to an image forming apparatus that forms multi-color (full color) images using toner (developing material) of multiple colors as embodiments of the present invention. Note that the present invention can also be applied to an image forming apparatus that forms mono-color images using only a single color of toner (e.g., black).

Hardware Configuration of Color Multi-function Printer

Figure 1:
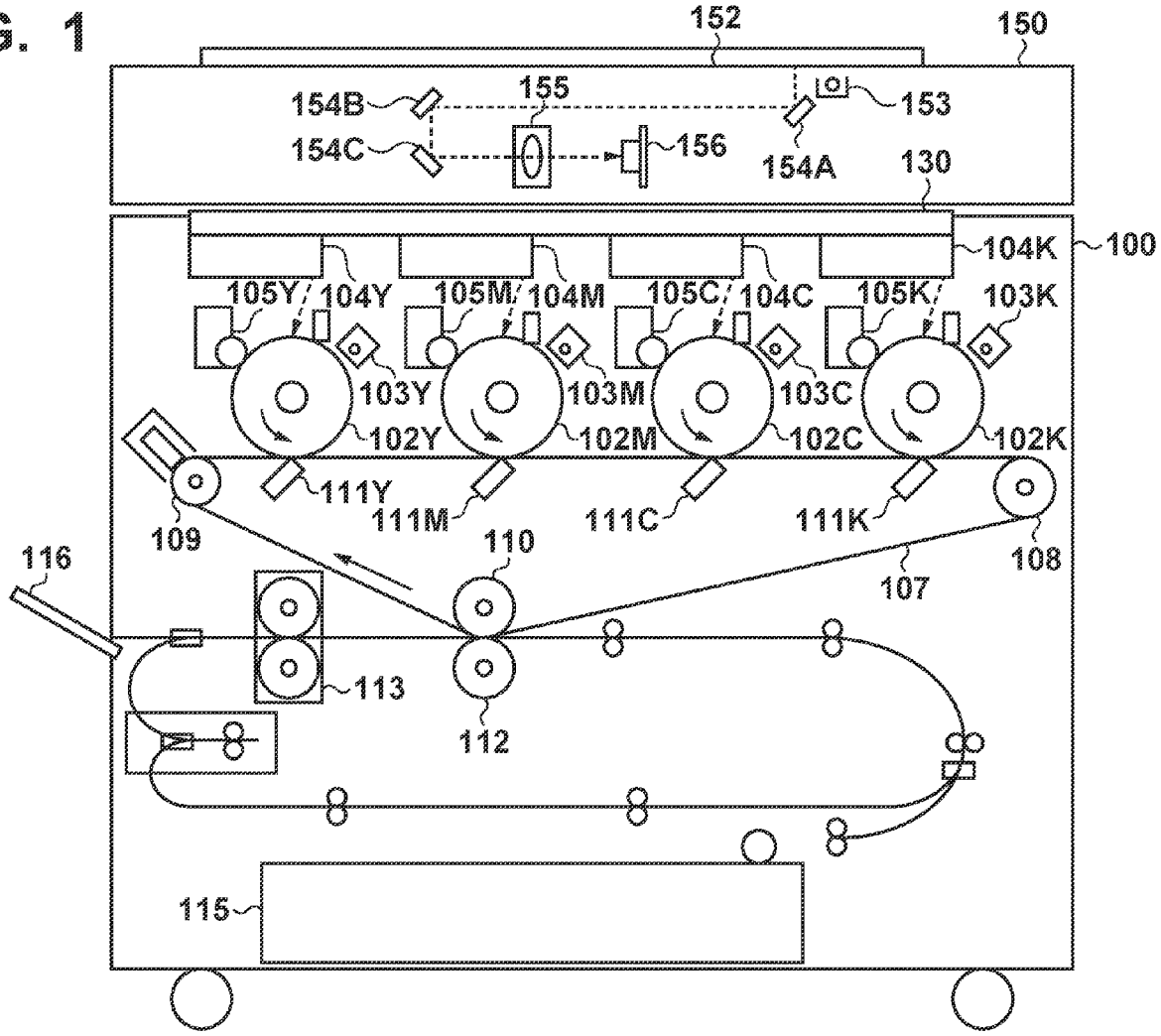
FIG. 1 is a cross-sectional view showing an example of an overall configuration of an image forming apparatus.

First, a configuration of a color multi-function printer according to embodiments of the present invention will be described with reference to FIG. 1. As shown in FIG. 1, a color multi-function printer is constituted by an image reading apparatus 150 and an image forming apparatus 100.

The image reading apparatus 150 forms an image of a document 152 on a color sensor 156 via an illumination lamp 153, a group of mirrors 154A, 154B, and 154C, and a lens 155. According to this, the image reading apparatus 150 reads an image of a document for each color-separated light of the colors blue (B), green (G), and red (R) for example, converts the images into electric image signals, and transmits them to a central image processor 130 in the image forming apparatus 100.

Figure 4:
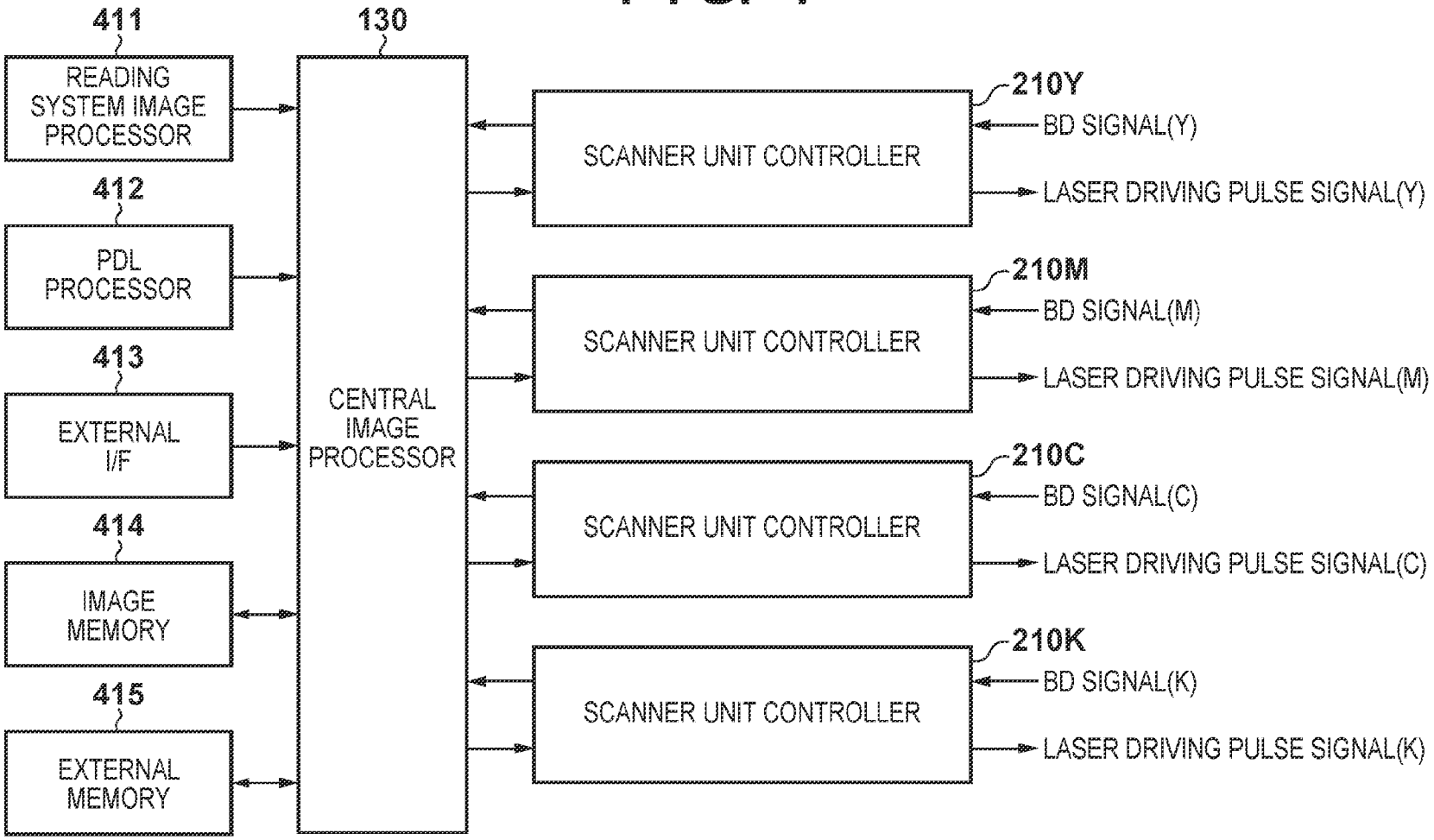
FIG. 4 is a block diagram showing an example of a control configuration of an image forming apparatus.

The central image processor 130 executes color conversion processing based on the intensity levels of the color components R, G, and B that are included in the image signals obtained by the image reading apparatus 150. According to this, image data composed of color components yellow (Y), magenta (M), cyan (C), and black (K) is obtained. The central image processor 130 can receive external input data not only from the image reading apparatus 150, but also from an external device on a network such as a phone line or a LAN via an external interface (I/F) 413 (FIG. 4) that is included in the color multi-function printer. In this case, if the data received from the external apparatus is in PDL (Page Description Language) format, the central image processor 130 can obtain image data by rendering received external input data into image information using a PDL processor 412 (FIG. 4).

The image forming apparatus 100 includes four image forming units that form images (toner images) using Y, M, C, and K toner respectively. The image forming units corresponding to the respective colors include photosensitive drums (photosensitive members) 102Y, 102M, 102C, and 102K respectively. Charging units 103Y, 103M, 103C, and 103K, optical scanning units (optical scanning apparatuses) 104Y, 104M, 104C, and 104K, and developing units 105Y, 105M, 105C, and 105K are arranged in the periphery of the photosensitive drums 102Y, 102M, 102C, and 102K respectively. Note that drum cleaning units (not shown) are further arranged in the periphery of the photosensitive drums 102Y, 102M, 102C, and 102K respectively.

An intermediate transfer belt (intermediate transfer member) 107 in the shape of an endless belt is arranged below the photosensitive drums 102Y, 102M, 102C, and 102K. The intermediate transfer belt 107 is wound around a driving roller 108 and driven rollers 109 and 110. When image formation is in progress, the peripheral surface of the intermediate transfer belt 107 moves in the direction of the arrow shown in FIG. 1 in accordance with the rotation of the driving roller 108. Primary transfer bias blades 111Y, 111M, 111C, and 111K are arranged at positions opposing the photosensitive drums 102Y, 102M, 102C, and 102K via the intermediate transfer belt 107. The image forming apparatus 100 further includes a secondary bias roller 112 for transferring the toner image formed on the intermediate transfer belt 107 onto a recording sheet (recording medium), and a fixing unit 113 for fixing, to the recording medium, the toner image that has been transferred onto the recording sheet.

Image forming processes from a charging process to a developing process in the image forming apparatus 100 having the above-described configuration will be described next. Note that the image forming processes executed by the respective image forming units that correspond to the respective colors are similar to each other. For this reason, a description will be given below using the image forming processes executed by the image forming unit corresponding to Y as an example, and the image forming processes in the image forming units corresponding to M, C, and K will not be described.

First, the charging unit 103Y in the image forming unit corresponding to Y charges the surface of the photosensitive drum 102Y that is being driven so as to rotate. The optical scanning unit 104Y emits multiple laser beams (light beams) and scans the charged surface of the photosensitive drum 102Y with the laser beams, thereby exposing the surface of the photosensitive drum 102Y. According to this, an electrostatic latent image is formed on the rotating photosensitive drum 102Y. After being formed on the photosensitive drum 102Y, the electrostatic latent image is developed by the developing unit 105Y using Y toner. As a result, a Y toner image is formed on the photosensitive drum 102Y. Also, in the image forming units corresponding to M, C, and K, M, C, and K toner images are formed on the photosensitive drums 102M, 102C, and 102K respectively with processes similar to that of the image forming unit corresponding to Y.

The image forming processes from a transfer process onward will be described below. In the transfer process, first, the primary transfer bias blades 111Y, 111M, 111C, and 111K apply a transfer bias to the intermediate transfer belt 107. According to this, toner images of four colors (Y, M, C, and K) that have been formed on the photosensitive drums 102Y, 102M, 102C, and 102K are transferred in an overlaid manner onto the intermediate transfer belt 107.

After being formed on the intermediate transfer belt 107 in an overlaid manner, the toner image composed of four colors of toner is conveyed to a secondary nip portion between the secondary transfer bias roller 112 and the intermediate transfer belt 107 in accordance with the movement of the peripheral surface of the intermediate transfer belt 107. A recording sheet is conveyed from a paper feeding cassette 115 to the secondary transfer nip portion in synchronization with the time at which the toner image formed on the intermediate transfer belt 107 is conveyed to the secondary transfer nip portion. In the secondary transfer nip portion, the toner image formed on the intermediate transfer belt 107 is transferred onto the recording sheet by a transfer bias applied by the secondary transfer bias roller 112 (secondary transfer).

After being formed on the recording sheet, the toner image undergoes heating in the fixing unit 113 and is thereby fixed to the recording sheet. After a multi-color (full color) image is formed in this way on the recording sheet, the recording sheet is discharged to a discharge unit 725.

Note that after the transfer of the toner image onto the intermediate transfer belt 107 ends, toner remaining on the photosensitive drums 102Y, 102M, 102C, and 102K is removed by the above-mentioned corresponding drum cleaning units. When a series of image forming processes ends in this way, image forming processes for the next recording sheet are subsequently started.

Hardware Configuration of Optical Scanning Unit

The configuration of the optical scanning units 104Y, 104M, 104C, and 104K will be described next with reference to FIG. 2 and FIGS. 3A to 3C. Note that since the configurations of the optical scanning units 104Y, 104M, 104C, and 104K (image forming units corresponding to Y, M, C, and K) are the same, there are cases below where reference numerals are used without the suffixes Y, M, C, and K. For example, "photosensitive drum 102" represents the photosensitive drums 102Y, 102M, 102C, and 102K, and "optical scanning unit 104" represents the optical scanning units 104Y, 104M, 104C, and 104K.

Figure 2:
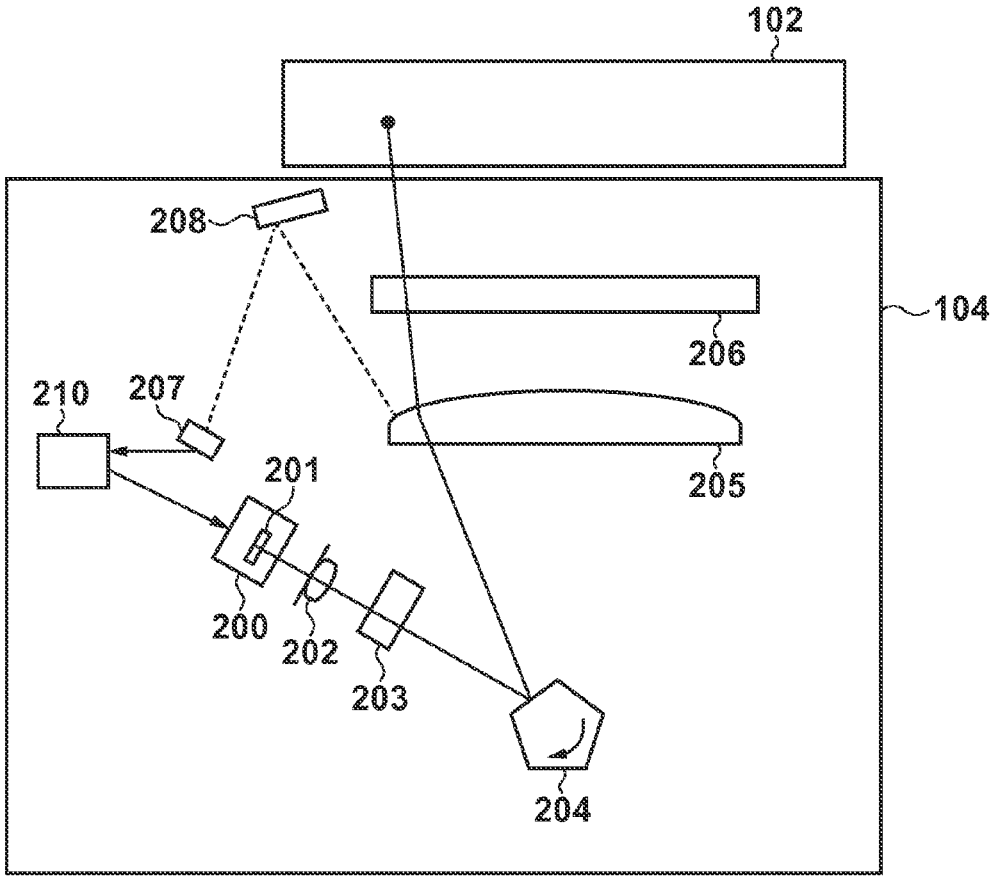
FIG. 2 is a diagram showing an example of an overall configuration of an optical scanning unit.

FIG. 2 is a diagram showing the configuration of the optical scanning unit 104. The optical scanning unit 104 includes a laser driver 200, a laser light source 201, and various optical members 202 to 206 (a collimator lens 202, a cylindrical lens 203, a polygon mirror (rotating polygonal mirror) 204, and fθ lenses 205 and 206). The laser driver 200 controls driving of the laser light source 201 using a driving current supplied to the laser light source 201. The laser light source (referred to hereinafter as simply "light source") 201 generates and outputs (emits) a laser beam (light beam) with a light power that corresponds to the driving current. The collimator lens 202 shapes the laser beams emitted from the light source 201 into collimated light. After the laser beam has passed through the collimator lens 202, the cylindrical lens 203 condenses the laser beam in the sub-scanning direction (direction corresponding to the rotation direction of the photosensitive drum 102).

After passing through the cylindrical lens 203, the laser beam is incident on one of the reflecting surfaces of the polygon mirror 204. The polygon mirror 204 rotates in the direction of the arrow shown in FIG. 2 and causes the laser beam to be reflected by the reflection surfaces such that the incident laser beam is deflected at continuous angles. The laser beam deflected by the polygon mirror 204 is sequentially incident on the fθ lenses 205 and 206. Due to passing through the fθ lenses (scanning lenses) 205 and 206, the laser beam becomes scanning beam that scans the surface of the photosensitive drum 102 at a constant speed.

On the scanning path of the laser beam that has passed through the fθ lens 205, the optical scanning unit 104 includes a reflection mirror (synchronization detection mirror) 208 at a position on the laser beam scan start side. A laser beam that has passed through the end of the fθ lens is incident on the reflection mirror 208. The optical scanning unit 104 further includes a beam detection (BD) sensor 207 as an optical sensor for detecting a laser beam, in the reflection direction of the laser beam from the reflection mirror 208. Thus, the BD sensor 207 is arranged on the scanning path of the laser beam deflected by the polygon mirror 204. That is to say, the BD sensor 207 is provided on the scanning path a laser beam emitted from the light source 201 scans the surface of the photosensitive drum 102.

When a laser beam deflected by the polygon mirror 204 is incident on the BD sensor 207, the BD sensor 207 outputs, as a synchronization signal (horizontal synchronization signal), a detection signal (BD signal) indicating that a laser beam has been detected by the BD sensor 207. The BD signal output from the BD sensor 207 is input to the scanner unit controller 210. As will be described later, the scanner unit controller 210 uses the BD signal output from the BD sensor 207 as a reference to control the turning-on times of the light emitting elements ($LD_1$ to $LD_N$) based on the image data.

Next, the configuration of the light source 201 and the scanning positions of laser beams emitted from the light source 201 on the photosensitive drum 102 and the BD sensor 207 will be described with reference to FIGS. 3A to 3C.

Figure 3A:
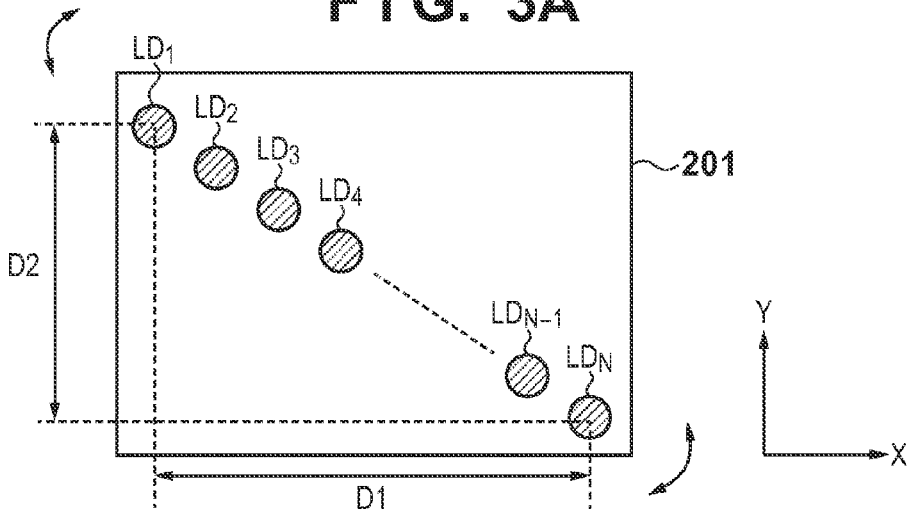
FIGS. 3A to 3C are diagrams showing an example of an overall configuration of a light source and an example of scanning positions for laser beams emitted from the light source on a photosensitive drum and a BD sensor.
Figure 3B:
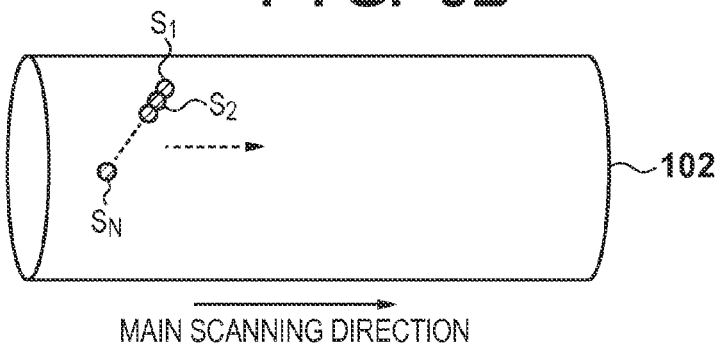

First, FIG. 3A is an enlarged view of the light source 201, and FIG. 3B is a diagram showing the scanning positions of the laser beams emitted from the light source 201 on the photosensitive drum 102. The light source 201 includes N light emitting elements ($LD_1$ to $LD_N$) that each emit (output) a laser beam. The n-th (n being an integer from 1 to N) light emitting element n ($LD_n$) of the light source 201 emits a laser beam $L_n$. The X axis direction in FIG. 3A is the direction that corresponds to the direction in which the laser beams deflected by the polygon mirror 204 scan the photosensitive drum 102 (the main scanning direction). Also, the Y axis direction is the direction orthogonal to the main scanning direction, and is the direction that corresponds to the rotation direction of the photosensitive drum 102 (sub-scanning direction).

As shown in FIG. 3B, the laser beams $L_1$ to $L_N$ that have been emitted from the light emitting elements 1 to N form spot-shaped images at positions $S_1$ to $S_N$ that are different in the sub-scanning direction on the photosensitive drum 102. According to this, the laser beams $L_1$ to $L_N$ scan main scanning lines that are adjacent in the sub-scanning direction in parallel on the photosensitive drum 102. Also, due to the light emitting elements 1 to N being arranged in an array as shown in FIG. 3A in the light source 201, the laser beams $L_1$ to $L_N$ form images at positions on the photosensitive drum 102 that are different in the main scanning direction as well, as shown in FIG. 3B. Note that in FIG. 3A, the N light emitting elements ($LD_1$ to $LD_N$) are arranged in one straight line (one-dimensionally) in the light source 201, but they may be arranged two-dimensionally.

Reference numeral D1 in FIG. 3A represents the interval (distance) between the light emitting element 1 ($LD_1$) and the light emitting element N ($LD_N$) in the X axis direction. In the embodiments, the light emitting elements 1 and N are light emitting elements arranged at the two ends of the light emitting elements that are arranged in a straight line in the light source 201. The light emitting element N is arranged the farthest from the light emitting element 1 in the X axis direction. For this reason, as shown in FIG. 3B, among the laser beams, the image forming position $S_N$ of the laser beam $L_N$ is at the position that is the farthest from the image forming position $S_1$ of the laser beam $L_1$ in the main scanning direction on the photosensitive drum 102.

Reference numeral D2 in FIG. 3A represents the interval (distance) between the light emitting element 1 ($LD_1$) and the light emitting element N ($LD_N$) in the Y axis direction. Among the light emitting elements, the light emitting element N is the farthest from the light emitting element 1 in the Y axis direction. For this reason, as shown in FIG. 3B, among the laser beams, the image forming position $S_N$ of the laser beam $L_N$ is at the position that is the farthest from the image forming position $S_1$ of the laser beam $L_1$ in the sub-scanning direction on the photosensitive drum 102.

A light emitting element interval Ps=D2/N−1 in the Y axis direction (sub-scanning direction) is an interval that corresponds to the resolution of the image that is to be formed by the image forming apparatus 100. Ps is a value that is set by performing rotation adjustment on the light source 201 in the assembly step of the image forming apparatus 100 (color multi-function printer) such that the interval between adjacent image forming positions $S_n$ in the sub-scanning direction on the photosensitive drum 102 becomes an interval that corresponds to a predetermined resolution. The light source 201 is subjected to rotation adjustment in the direction of the arrows in the plane including an X axis and a Y axis (XY plane), as shown in FIG. 3A. When the light source 201 is rotated, the interval between the light emitting elements in the Y axis direction changes, and the interval between the light emitting elements in the X axis direction changes as well. A light emitting element interval Pm=D1/N−1 in the X axis direction (main scanning direction) is a value that is determined uniquely depending on the light emitting element interval Ps in the Y axis direction.

The times at which the laser beams are to be emitted from the light emitting elements ($LD_n$), and which are determined using the timing of the generation and output of the BD signals by the BD sensor 207 as a reference, are set using a predetermined jig for each light emitting element in the assembly step. The set times for the respective light emitting elements are stored in a memory 406 (FIG. 5) as initial values at the time of factory shipping of the image forming apparatus 100 (color multi-function printer). The initial values for the times at which the laser beams are to be emitted from the light emitting elements ($LD_n$) set in this way have values corresponding to Pm.

Figure 3C:
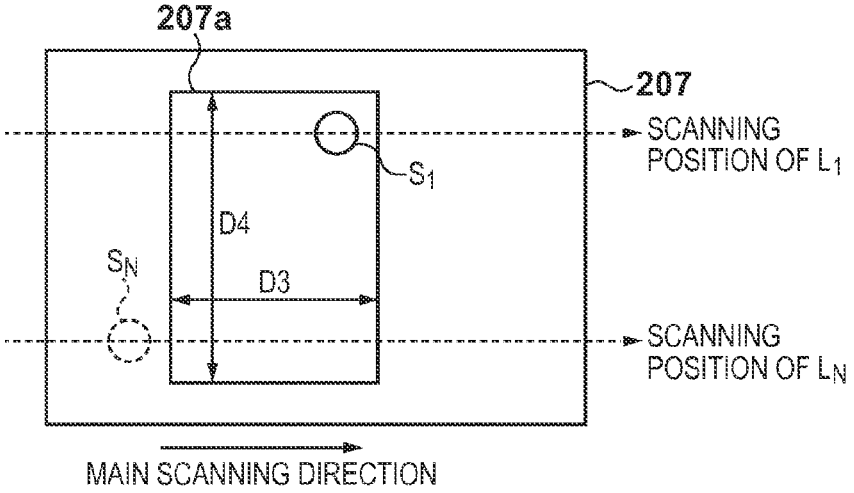

Next, FIG. 3C is a diagram showing a schematic configuration of the BD sensor 207 and the scanning positions of the laser beams emitted from the light source 201 on the BD sensor 207. The BD sensor 207 includes a light-receiving surface 207*a* on which photoelectric conversion elements are arranged planarly. When a laser beam is incident on the light-receiving surface 207*a*, the BD sensor 207 generates and outputs a BD signal indicating that a laser beam has been detected. In a later-described BD interval measurement, the optical scanning unit 104 causes the laser beams $L_1$ and $L_N$ that have been emitted from the light emitting elements 1 and N ($LD_1$ and $LD_N$) to be incident on the BD sensor 207 sequentially. According to this, the optical scanning unit 104 causes two BD signals corresponding to the respective laser beams to be output sequentially from the BD sensor 207. Note that in the embodiments, the light emitting elements 1 and N ($LD_1$ and $LD_N$) are examples of a first light emitting element and a second light emitting element respectively.

In FIG. 3C, the width in the main scanning direction and the width in the direction corresponding to the sub-scanning direction of the light-receiving surface 207*a* are indicated as D3 and D4 respectively. In the embodiments, the laser beams $L_1$ and $L_N$ that are emitted from the light emitting elements 1 and N ($LD_1$ and $LD_N$) respectively scan the light-receiving surface 207*a* of the BD sensor 207 as shown in FIG. 3C. For this reason, the width D4 is set to a value that satisfies the condition D4>D2×α, such that both of the laser beams $L_1$ and $L_N$ can be incident on the light-receiving surface 207*a*. Note that α is the rate of fluctuation in the sub-scanning direction with respect to the interval between the laser beams $L_1$ and $L_N$ that have passed through the various lenses. Also, the width D3 is set to a value that satisfies the condition D3<D1×β, such that the laser beams $L_1$ and $L_N$ are not incident on the light-receiving surface 207*a* at the same time even when the light emitting elements 1 and N ($LD_1$ and $LD_N$) are illuminated at the same time. Note that β is the rate of fluctuation in the main scanning direction with respect to the interval between the laser beams $L_1$ and $L_N$ that have passed through the various lenses.

Control Configuration of Image Forming Apparatus

A control configuration of the image forming apparatus 100 will be described next with reference to FIG. 4. As shown in FIG. 4, as a control configuration related to image formation, the image forming apparatus 100 includes the central image processor 130, a reading system image processor 411, a PDL processor 412, an external I/F 413, an image memory 414, an external memory 415, and scanner unit controllers 210Y, 210M, 210C, and 210K.

The central image processor 130 temporarily stores, in the image memory 414, image data that has been subjected to PDL processing and the like by the PDL processor 412. The scanner unit controller 210 makes a request for image data to the central image processor 130 at a later-described time. After reading out image data from the image memory 414 in response to the request and performing image processing using the external memory 415 and the like, the central image processor 130 transmits the image data corresponding to each color to the scanner unit controller 210.

A signal generated and output by the BD sensor 207 is input to the scanner unit controller 210. The scanner unit controller 210 converts the image data received from the central image processor 130 into a laser driving pulse signal for controlling the light source 201. Furthermore, using the time at which the BD signal was generated by the BD sensor 207 as a reference, the scanner unit controller 210 outputs the laser driving pulse signal to the laser driver 200.

Control Configuration of Optical Scanning Unit

Figure 5:
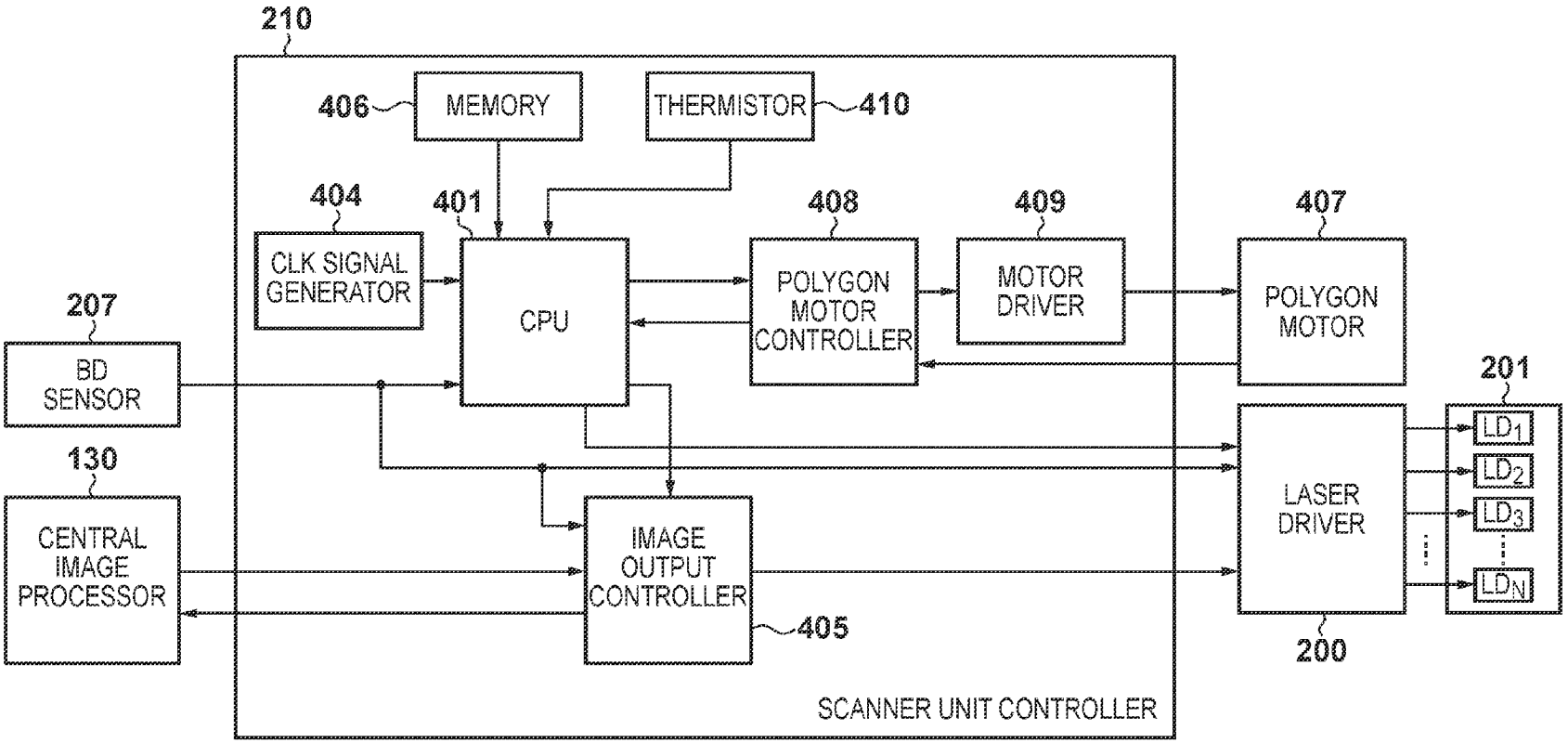
FIG. 5 is a block diagram showing an example of a configuration of a scanner unit controller.

The control configuration of the optical scanning unit 104 will be described next with reference to FIG. 5. FIG. 5 is a block diagram showing the configuration of the scanner unit controller 210. The scanner unit controller 210 includes a CPU 401, a clock (CLK) signal generator 404, an image output controller 405, a memory (storage unit) 406, a polygon motor controller 408, a motor driver 409, and a thermistor (temperature sensor) 410.

The CPU 401 performs overall control of the optical scanning unit 104 by executing a control program stored in the memory 406. The CLK signal generator 404 generates clock signals (CLK signals) at a predetermined frequency and outputs the generated CLK signals to the CPU 401. The CPU 401 counts the pulses of the CLK signal input from the CLK signal generator 404 and transmits a control signal to the polygon motor controller 408, the image output controller 405, and the laser driver 200 in synchronization with the CLK signal. The CPU 401 uses the control signal to control the polygon motor controller 408, the image output controller 405, and the laser driver 200.

The polygon motor controller 408 controls the rotation speed of the polygon mirror 204 by outputting an acceleration signal or a deceleration signal to the motor driver 409 in accordance with an instruction from the CPU 401. The polygon motor 407 is a motor that drives the polygon mirror 204 so as to rotate. The motor driver 409 causes the rotation of the polygon motor 407 to accelerate or decelerate in accordance with an acceleration signal or a deceleration signal output from the polygon motor controller 408.

The polygon motor 407 includes a speed sensor (not shown) that employs an FG (Frequency Generator) scheme for generating frequency signals that are proportional to the rotation speed of the polygon mirror 204. The polygon motor 407 uses the speed sensor to generate FG signals at a frequency corresponding to the rotation speed of the polygon mirror 204 and outputs the FG signals to the polygon motor controller 408. The polygon motor controller 408 measures the period for generating the FG signals input from the polygon motor 407, and when the measured period for generating the FG signals reaches a predetermined target period, the polygon motor controller 408 determines that the rotation speed of the polygon mirror 204 has reached the predetermined target rotation speed. Thus, the polygon motor controller 408 uses feedback control to control the rotation speed of the polygon mirror 204 according to the instruction from the CPU 401. Note that the CPU 401 can also determine the rotation speed of the polygon mirror 204 by receiving the FG signals output from the polygon motor 407 via the polygon motor controller 408.

BD signals generated and output by the BD sensor 207 are input to the CPU 401, the image output controller 405, and the laser driver 200. When the image output controller 405 receives input of a BD signal output from the BD sensor 207 at the time of image formation, the image output controller 405 makes a request to the central image processor 130 for each line of image data. The image output controller 405 converts each line of image data acquired from the central image processor 130 in response to the request into a laser driving pulse signal and outputs the laser driving pulse signal to the laser driver 200.

At the time of image formation, upon receiving input of a BD signal output from the BD sensor 207, the CPU 401 uses the BD signal as a reference to transmit a control signal for controlling the emission times of the laser beams from the light emitting elements 1 to N to the image output controller 405. The emission times of the laser beams from the light emitting elements 1 to N are controlled such that the writing start positions, in the main scanning direction, of the electrostatic latent images (images) for the light emitting elements 1 to N coincide. The image output controller 405 transfers the laser driving pulse signals corresponding to the image data for each line for the respective light emitting elements to the laser driver 200 at a timing based on the control signal.

A driving current based on the image data for image formation input from the image output controller 405 (i.e., a driving current modulated according to the image data) is supplied by the laser driver 200 to each of the light emitting elements ($LD_1$ to $LD_N$) at the time of image formation. According to this, the laser driver 200 causes a laser beam having a light power that corresponds to the driving current to be emitted from each of the light emitting elements.

The thermistor 410 measures the temperature of the scanner unit controller 210 (the internal temperature of the optical scanning unit 104 (image forming apparatus 100)) and outputs the measurement result to the CPU 401. Note that the thermistor 410 may be configured to measure the temperature of the light source 201.

Influence of Temperature Change on Optical Scanning Unit

Figure 6A:
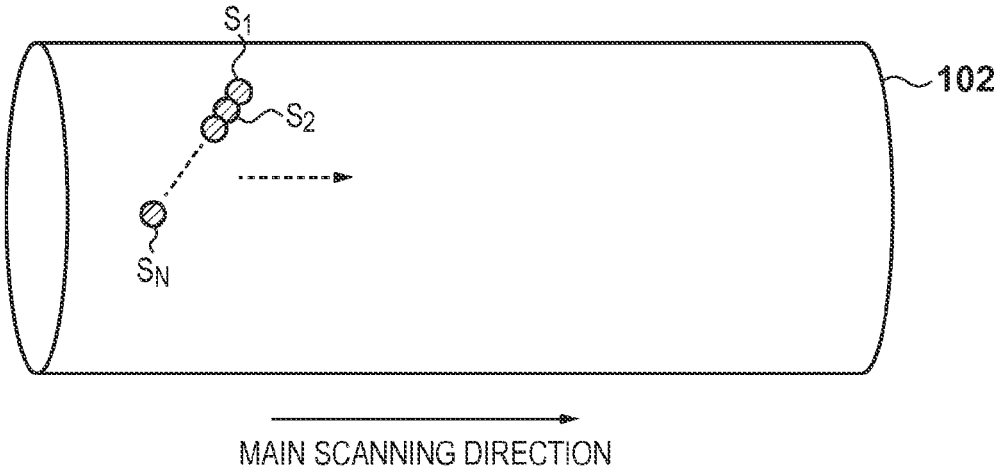
FIGS. 6A and 6B are diagrams showing an example of change in scanning positions of laser beams emitted from a light source on a photosensitive drum.

In the image forming apparatus 100, due to the configuration of the light sources 201 as shown in FIG. 3A, the laser beams emitted from the light emitting elements form images on the photosensitive drum 102 at positions $S_1$ to $S_N$ that are different in the main scanning direction as shown in FIG. 6A. In this kind of image forming apparatus, it is necessary to appropriately control the laser beam emission time for each light emitting element in order to align the writing start positions, in the main scanning direction, of the electrostatic latent images (images) that are formed by the laser beams emitted from the light emitting elements.

For example, a single BD signal is generated based on a laser beam emitted from a specific light emitting element, and the BD signal is used as a reference to control the light emitting elements such that the laser beams are emitted at fixed timings set in advance for the respective light emitting elements. According to this control, it is possible to cause the writing start positions, in the main scanning direction, of the electrostatic latent images (images) formed by the laser beams emitted from the light emitting elements to coincide, as long as the relative positional relationships between the image forming positions $S_1$ to $S_N$ are always constant during image formation.

Figure 6B:
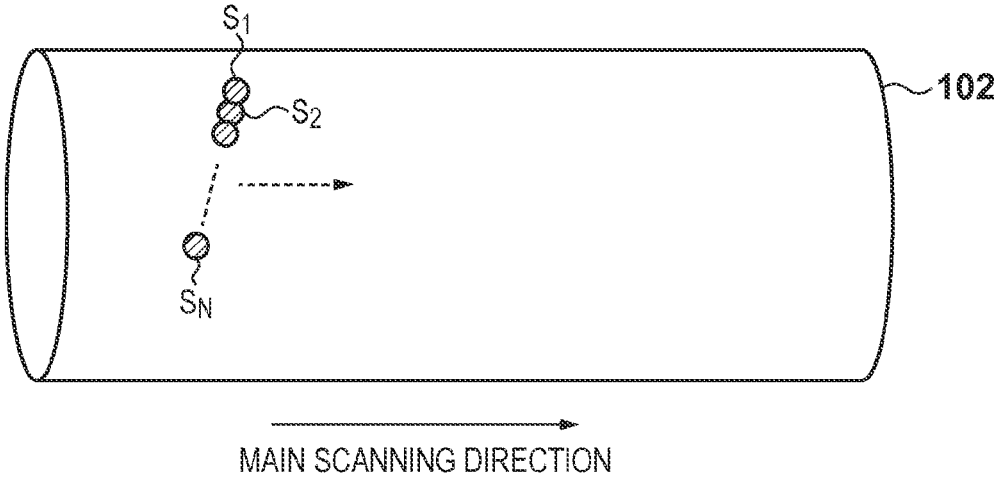

However, when the light emitting elements emit laser beams at the time of image formation, the wavelengths of the laser beams emitted from the light emitting elements change due to an increase in the temperatures of the light emitting elements. Also, due to the heat generated from the polygon motor 407 when rotating the polygon mirror 204, the temperature of the entire optical scanning unit 104 increases and the optical characteristics (refractive index, etc.) of the scanning lenses 205 and 206 and the like change. This causes the optical paths of the laser beams emitted from the light emitting elements to change. When this kind of change in the wavelength or optical path of the laser beams occurs, the image formation positions $S_1$ to $S_N$ of the laser beams change from the positions shown in FIG. 6A to the positions shown in FIG. 6B for example. When the relative positional relationship among the image forming positions $S_1$ to $S_N$ changes in this way, the writing start positions, in the main scanning direction, of the electrostatic latent images that are to be formed by the laser beams emitted from the light emitting elements cannot be caused to coincide by the laser emission timing control based on one BD signal described above.

In view of this, in the embodiments, two BD signals are generated by the BD sensor 207 using the laser beams emitted from two of the light emitting elements 1 to N (first and second light emitting elements), and the time interval between the two BD signals (also referred to as "BD interval" in the present specification) is measured. This BD interval measurement is performed in a non-image-forming period, which is a period of scanning a region other than an image-forming region on the photosensitive drum 102. After the non-image-forming period, in an image-forming period in which an image-forming region on the photosensitive drum 102 is scanned, the laser beam emission times based on the image data for the respective light emitting elements are controlled, by using a single BD signal as a reference, according to the measurement value obtained by the BD interval measurement. For example, in the case of performing image formation on multiple recording sheets, the non-image-forming period in which BD interval measurement is performed is the period after an image is formed on a recording sheet and before image formation on a subsequent recording sheet is started. Accordingly, even if a temperature change occurs in a light emitting element or the like while image formation is being executed, the laser emission times can be controlled such that the writing start positions, in the main scanning direction, of the electrostatic latent images formed by the laser beams emitted from the light emitting elements coincide.

BD Interval Measurement and Laser Emission Timing Control

Next, operations at the time of BD interval measurement and at the time of image formation in the optical scanning unit 104 according to the embodiments will be described with reference to FIGS. 7A, 7B, and 8.

At the time of BD interval measurement, the CPU 401 controls the light source 201 via the laser driver 200 such that two of the light emitting elements emit respective laser beams sequentially and the laser beams are sequentially incident on the BD sensor 207. That is to say, the BD interval measurement is performed based on two BD signals output sequentially from the BD sensor 207 (double BD mode). On the other hand, at the time of image formation, the CPU 401 controls the light source 201 via the laser driver 200 such that a laser beam emitted by a specific light emitting element is incident on the BD sensor 207. Furthermore, by using, as a reference, a single BD signal which is output from the BD sensor 207 in response to the laser beam being incident on the BD sensor 207, the CPU 401 controls the laser beam emission times based on the image data for the respective light emitting elements (single BD mode).

Figure 7A:
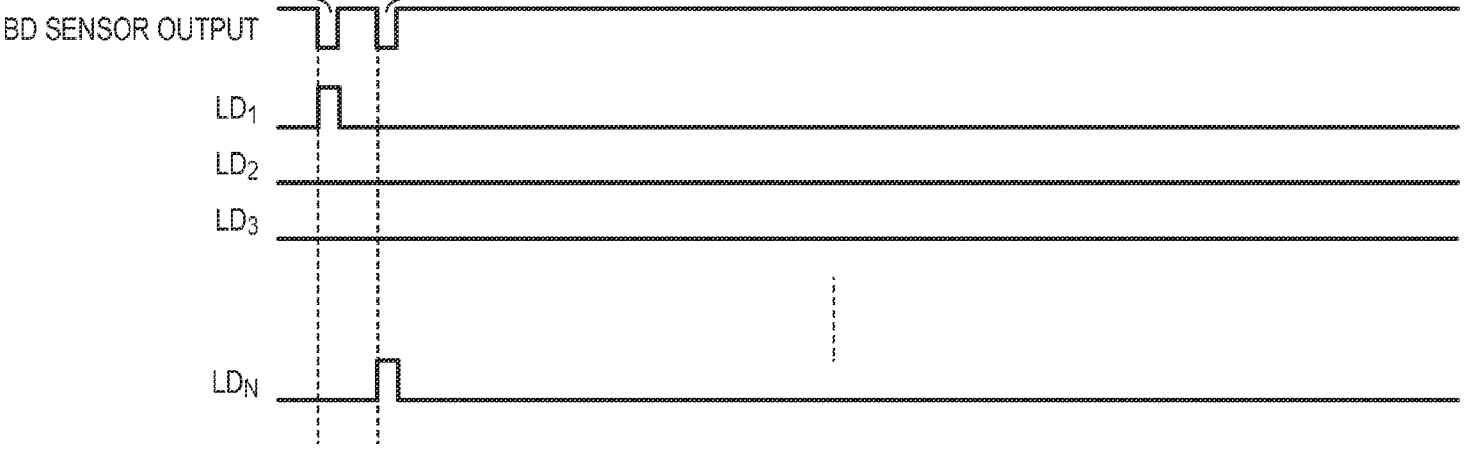
FIGS. 7A and 7B are timing charts showing the timing of light emitting element operations and the timing of BD signal generation performed by a BD sensor in one laser beam scanning period, at the time of BD interval measurement and image formation.
Figure 7B:
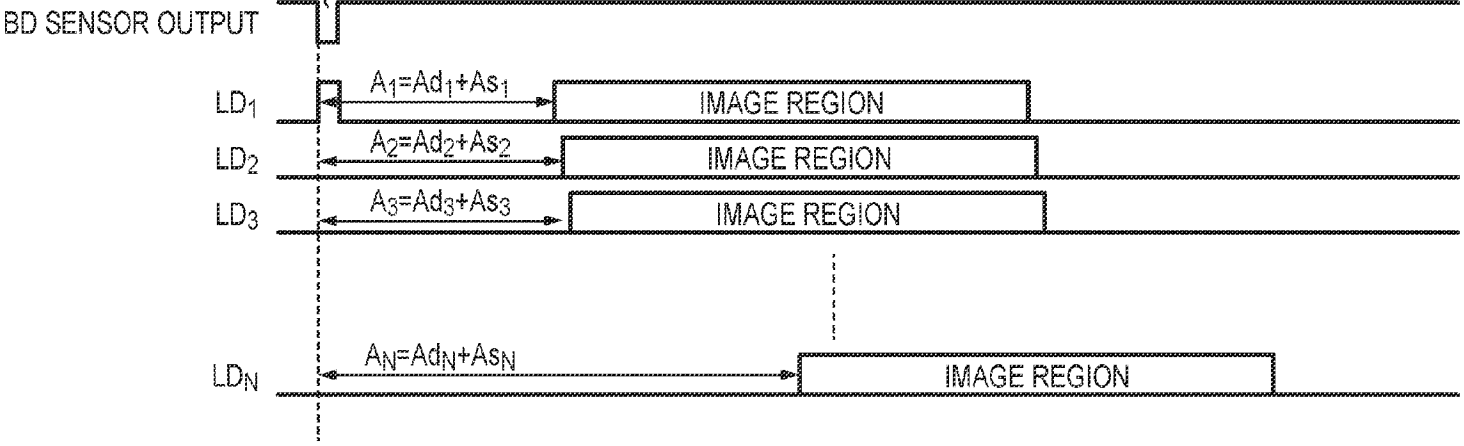
Figure 8:
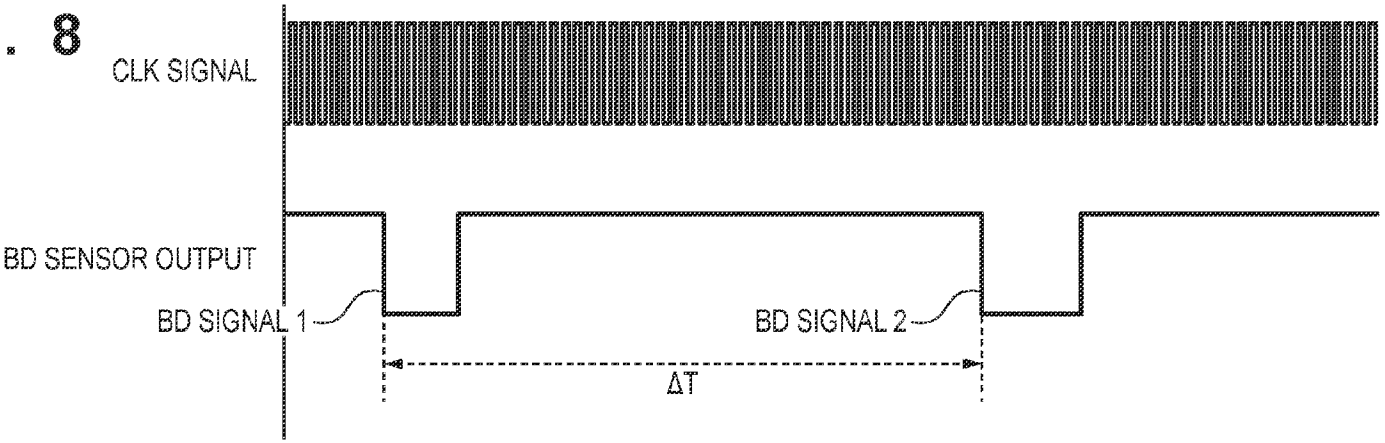
FIG. 8 is a diagram showing a relationship between BD interval measurement and CLK signals.

FIGS. 7A and 7B are timing charts showing the timing of operations performed by the light emitting elements and the timing of BD signal generation performed by the BD sensor in one laser beam scanning period, at the time of BD interval measurement and the time of image formation. Note that it is assumed hereinafter that the light emitting elements 1 and N are used to generate the two BD signals in the BD interval measurement, and the light emitting element 1 is used to generate the single BD signal at the time of image formation.

As shown in FIG. 7A, at the time of BD interval measurement executed in a non-image-forming period, drive signals are supplied from the laser driver 200 to the light emitting elements 1 and N respectively such that the laser beams emitted from the light emitting elements 1 and N ($LD_1$ and $LD_N$) are sequentially incident on the BD sensor 207. As a result, a BD signal generated by the BD sensor 207 due to reception of a laser beam from the light emitting element 1, and a BD signal generated by the BD sensor 207 due to reception of a laser beam from the light emitting element N are output from the BD sensor 207 (double BD mode). The CPU 401 performs measurement of the time interval between the times at which the two BD signals output sequentially from the BD sensor 207 are generated (BD interval measurement).

On the other hand, as shown in FIG. 7B, at the time of image formation, a drive signal is first supplied from the laser driver 200 to the light emitting element 1 such that the laser beam emitted from the light emitting element 1 ($LD_1$) is incident on the BD sensor 207. As a result, the single BD signal generated by the BD sensor 207 due to reception of the laser beam from the light emitting element 1 is output from the BD sensor 207 (single BD mode). Thereafter, when an image is to be formed on a recording sheet, the CPU 401 controls the laser emission times of the light emitting elements 1 to N, based on the single BD signal output from the BD sensor 207 and the emission start timing values $A_1$ to $A_N$ that are set with respect to the light emitting elements.

The emission start timing values $A_1$ to $A_N$ shown in FIG. 7B correspond to the light emission start times, of the light emitting elements 1 to N, that are based on the time at which the single BD signal was generated by the BD sensor 207. That is to say, $A_1$ to $A_N$ correspond to the relative delay times, for the respective light emitting elements 1 to N, of the emission times of the laser beams based on the image data, with respect to the single BD signal output from the BD sensor 207. $A_1$ to $A_N$ are set so as to coincide the writing start positions, in the main scanning direction, of the electrostatic latent images (images) formed by the laser beams emitted from the respective light emitting elements 1 to N.

$A_1$ to $A_N$ are obtained by using a correction value $As_n$ to correct the reference timing value $Ad_n$ for each of the light emitting elements, as shown in the following equation.

$$A_n = Ad_n + As_n \quad (n=1, 2, \ldots, N) \tag{1}$$

The CPU 401 controls the laser emission timings of the light emitting elements 1 to N by setting $A_1$ to $A_N$ in the image output controller 405. As shown in FIG. 7B, the image output controller 405 uses the generation time of the single BD signal as a reference to output the image data corresponding to each of the light emitting elements to the laser driver 200 at a timing in accordance with each of $A_1$ to $A_N$. According to this, at the timings in accordance with $A_1$ to $A_N$, the light emitting elements are driven by the laser driver 200, and each line of the electrostatic latent image (image) is formed at the desired main scanning position on the photosensitive drum 102.

The reference timing values $Ad_1$ to $Ad_N$ are values that are determined for the light emitting elements 1 to N at the time of factory adjustment under a specific temperature condition such that the electrostatic latent images are formed at the desired main scanning position, and the writing start positions of the electrostatic latent images in the main scanning direction coincide among multiple lines. $Ad_1$ to $Ad_N$ are stored in advance in the memory 406. Note that at the time of factory adjustment, the BD interval measurement is performed under the same temperature condition, and the count value, which is the result of the measurement, is stored in advance in the memory 406 as a reference count value Cr. Thus, the reference timing values $Ad_1$ to $Ad_N$ are set in advance in association with the reference count value Cr.

Here, the count value corresponds to a value obtained by the CPU 401 counting the pulses of the CLK signal generated by the CLK signal generator 404. When BD interval measurement is to be performed, as shown in FIG. 8, the CPU 401 generates a count value by counting the pulses of the CLK signal in the period from when the BD signal 1 corresponding to the light emitting element 1 is generated until when the BD signal 2 corresponding to the light emitting element N is generated. The count value corresponds to a BD signal time interval ΔT and is generated as the measurement result of the BD interval measurement.

On the other hand, when the image forming positions $S_1$ to $S_N$ become misaligned due to a temperature change in light emitting elements or the like, it will no longer be possible to cause the writing start positions of the electrostatic latent image in the main scanning direction to coincide among multiple lines as described above. For this reason, the correction values $As_1$ to $As_N$ are generated by the CPU 401 using the following equation in order to compensate for this kind of misalignment in the image forming positions $S_1$ to $S_N$.

$$As_n=(Cs-Cr)/(N-1)\times k\times(n-1)\ (n=1, 2, \ldots, N) \quad (2)$$

Here, n represents the number of a light emitting element. Cs is a count value that corresponds to the measurement results of the later-described BD interval measurements 1 and 2, and that is stored in the memory 406 (in steps S127 and S147). Cr is a reference value for BD interval measurement that is obtained using measurement at the time of factory adjustment. k is a conversion coefficient for converting the count value indicating the time interval between the two BD signals into the time interval for scanning in the image formation position on the photosensitive drum 102.

As can be understood from Equation (2), the correction value $As_1$ corresponding to the light emitting element 1 is always 0. For this reason, using the image forming position $S_1$ corresponding to the light emitting element 1 as a reference, Equation (2) generates correction values for correcting a misalignment among the image forming positions $S_1$ to $S_N$ due to a temperature change in light emitting elements or the like. As shown in Equation (1) and FIG. 7B, the CPU 401 can calculate the light emission start timing values $A_1$ to $A_N$ that are to be set with respect to the light emitting elements 1 to N, by respectively adding calculated $As_1$ to $As_N$, to $Ad_1$ to $Ad_N$, which are stored in the memory 406.

Embodiments 1 to 4 will be described hereinafter as specific embodiments of the present invention. In Embodiments 1 to 4, BD interval measurement is executed according to two operation modes. A BD interval measurement according to a BD interval measurement mode 1 (mode 1) is an operation that is executed in a non-image-forming period prior to starting the image formation according to the input of an image formation job. A BD interval measurement according to a BD interval measurement mode 2 (mode 2) is an operation that is executed in a non-image-forming period after starting the execution of an image formation job, between a period of image formation with respect to a recording sheet and a period of image formation with respect to a subsequent recording sheet. Note that in the following embodiments, an example is given in which it is assumed that the light source 201 includes 32 light emitting elements (i.e., N=32).

Embodiment 1

In Embodiment 1, in order to control the laser emission times of the light emitting elements so as to follow a temperature change in a light emitting element or the like during image formation, BD interval measurement is executed in a predetermined time interval (each time image formation is performed on a predetermined number of recording sheets) using a non-image-forming period in which image formation is not performed.

Figure 11:
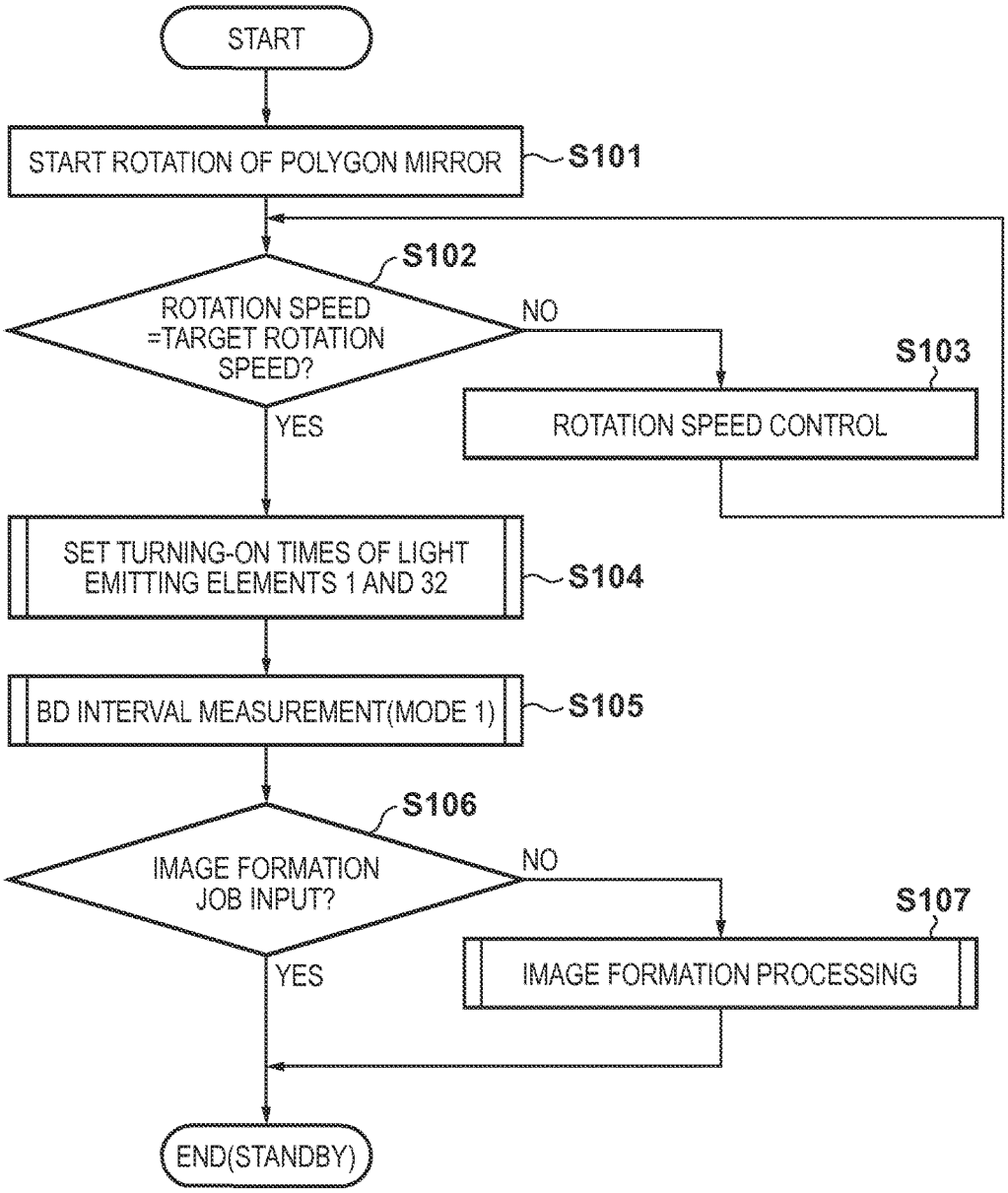
FIG. 11 is a flowchart showing a procedure of processing related to image formation, which is executed by an optical scanning unit 104 according to Embodiment 1.

FIG. 11 is a flowchart showing a procedure of processing related to image formation, which is executed by the optical scanning unit 104 according to Embodiment 1. The processing of the steps shown in FIG. 11 is realized by the CPU 401 reading out a control program stored in the memory 406 and executing it. The CPU 401 starts the processing of step S101 when the power source of the image forming apparatus 100 is started from a stopped state, or when returning from a standby state.

In step S101, the CPU 401 transmits a control signal for starting the rotation of the polygon mirror 204 to the polygon motor controller 408. The polygon motor controller 408 drives the motor driver 409 according to the control signal from the CPU 401 so as to start the rotation of the polygon mirror 204. The polygon motor controller 408 controls the motor driver 409 based on an FG signal output from the polygon motor 407, such that the polygon mirror 204 rotates at a predetermined target rotation speed.

Next, in step S102, the CPU 401 determines whether or not the polygon mirror 204 is rotating at the target rotation speed. Here, the CPU 401 can execute the determination by receiving the FG signals output from the polygon motor 407 via the polygon motor controller 408. If the CPU 401 has determined that the polygon mirror 204 is not rotating at the target rotation speed, in step S103, it uses a control signal to give an instruction to the polygon motor controller 408 to continue rotation speed control for bringing the rotation speed of the polygon mirror 204 closer to the target rotation speed. On the other hand, if the CPU 401 has determined that the polygon mirror 204 is rotating at the target rotation speed, it advances the process to the processing of step S104.

(Turning-on Timing Setting of the Light Emitting Elements 1 and 32)

Figure 12:
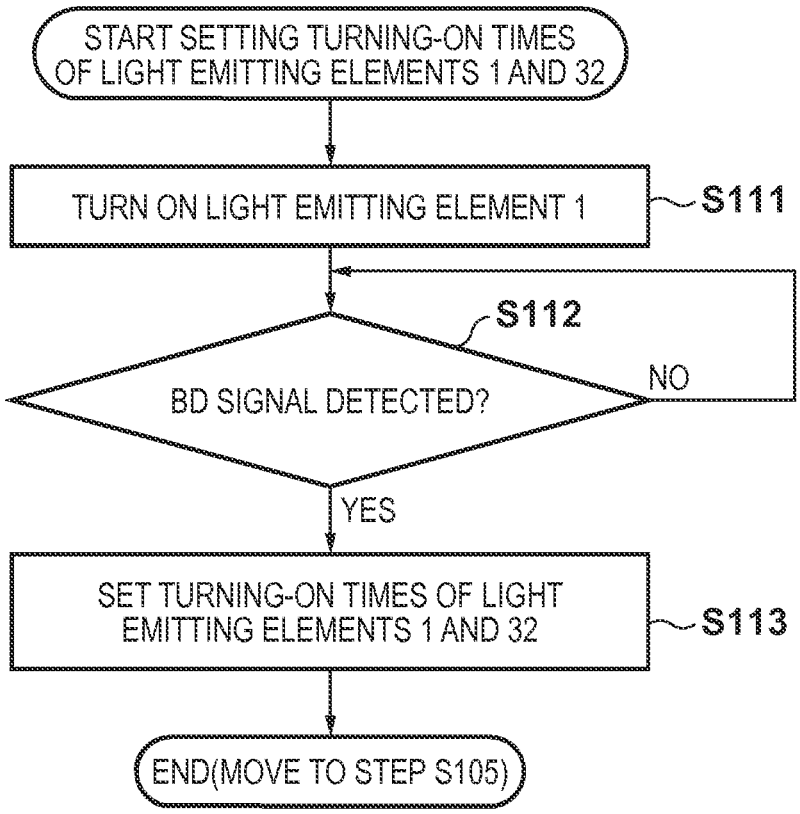
FIG. 12 is a flowchart showing a procedure for setting turning-on times of light emitting elements 1 and 32 according to Embodiment 1.

In step S104, the CPU 401 sets the turning-on times of the light emitting elements 1 and 32 that are to be used in the BD interval measurement (mode 1), in accordance with the procedure shown in FIG. 12. When the polygon mirror 204 is rotating at the target rotation speed, the CPU 401 needs to cause the light emitting elements 1 and 32 to be turned on (emit light) at the appropriate times such that the laser beams emitted from the light emitting elements 1 and 32 scan the light-receiving surface 207*a* of the BD sensor 207. For this reason, the CPU 401 specifies such times in steps S111 to S113 in FIG. 12.

First, in step S111, the CPU 401 controls the laser driver 200 so as to turn on the light emitting element 1. Next, in step S112, based on the input from the BD sensor 207, the CPU 401 determines whether or not at least one BD signal has been generated by the BD sensor 207. In step S112, if it is determined that a BD signal has not been generated, the CPU 401 continues turning on the light emitting element 1, and if it is determined that a BD signal has been generated, the CPU 401 advances the process to step S113. In step S113, the CPU 401 sets the turning-on times of the light emitting elements 1 and 32 based on the data stored in advance in the memory 406 and the time at which the BD signal was generated.

Specifically, data relating to the turning-on time for causing the laser beam from the light emitting element 1 to be incident on the BD sensor 207 when the polygon mirror 204 is rotating at the target rotation speed, and for causing the BD sensor 207 to generate the BD signal is stored in advance in the memory 406. This data indicates the time interval between the generation time of the BD signal and the turning-on time for causing the next BD signal to be generated. For this reason, if the generation time of one BD signal can be specified in step S112, the CPU 401 can specify the turning-on time of the light emitting element 1 for causing the BD sensor 207 to generate the next BD signal, based on the data stored in the memory 406.

Also, data relating to the turning-on time for causing the laser beam from the light emitting element 32 to be incident on the BD sensor 207 when the polygon mirror 204 is rotating at the target rotation speed, and for causing the BD sensor 207 to generate the BD signal is stored in advance in the memory 406. This data indicates the relative delay time of the light emission time for causing the laser beam emitted from the light emitting element 32 to be incident on the BD sensor 207, with respect to the turning-on time for causing the laser beam from the light emitting element 1 to be incident on the BD sensor 207. For this reason, if the generation time of one BD signal can be specified in step S112, the CPU 401 can specify the turning-on time of the light emitting element 32 for causing the BD sensor 207 to generate the next BD signal, based on the data stored in the memory 406.

Upon completing the setting of the turning-on times of the light emitting elements 1 and 32 in step S113, the CPU 401 advances the process to step S105.

(BD Interval Measurement Mode 1)

Figure 13:
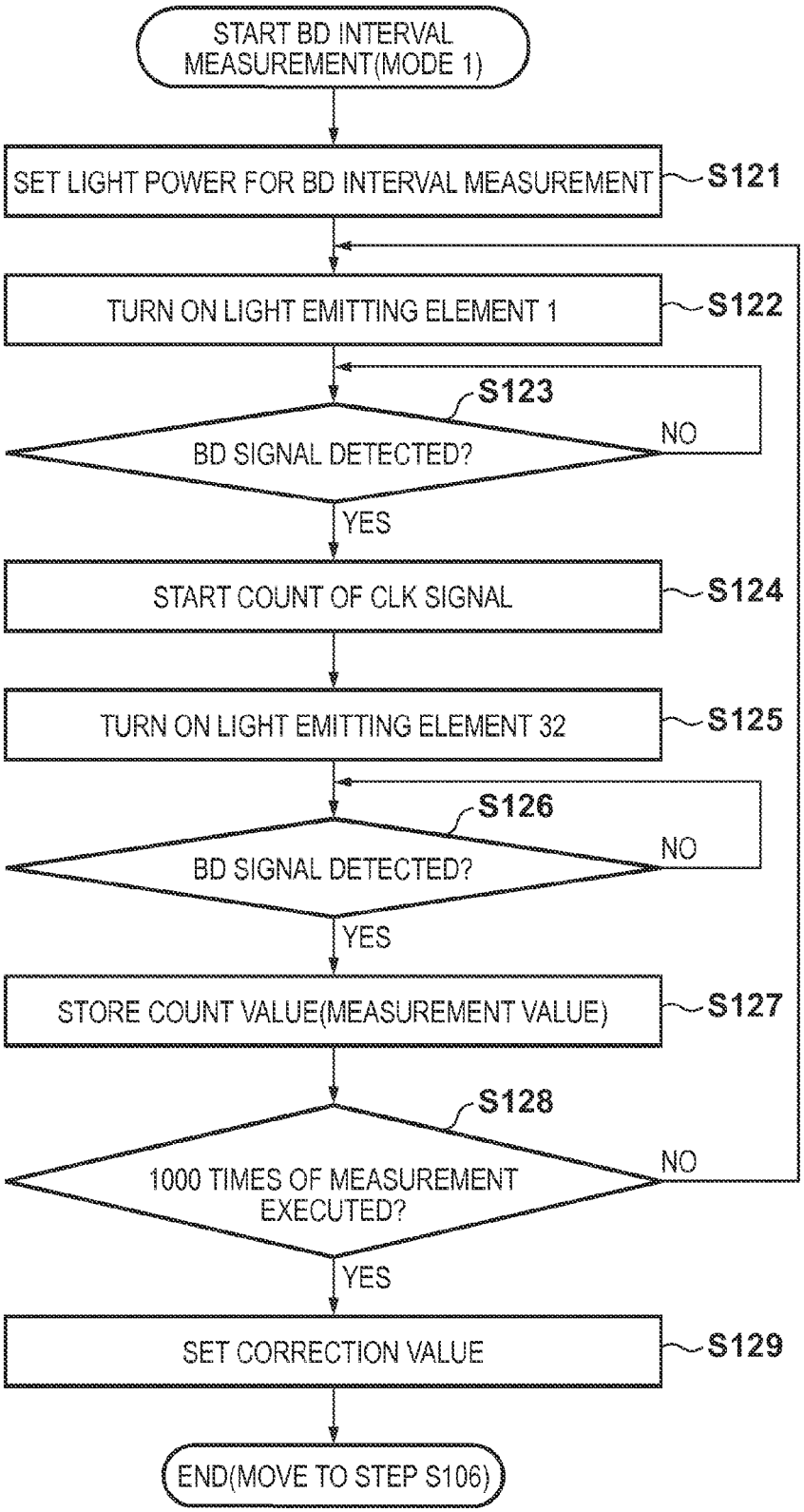
FIG. 13 is a flowchart showing a procedure of BD interval measurement (mode 1) according to Embodiment 1.

In step S105, in accordance with the procedure shown in FIG. 13, the CPU 401 executes BD interval measurement (mode 1) based on the turning-on times of the light emitting elements 1 and 32 that have been set in step S104. Specifically, when starting BD interval measurement (mode 1), in step S121, the CPU 401 sets the light power for BD interval measurement for the light emitting elements 1 and 32.

Figure 9:
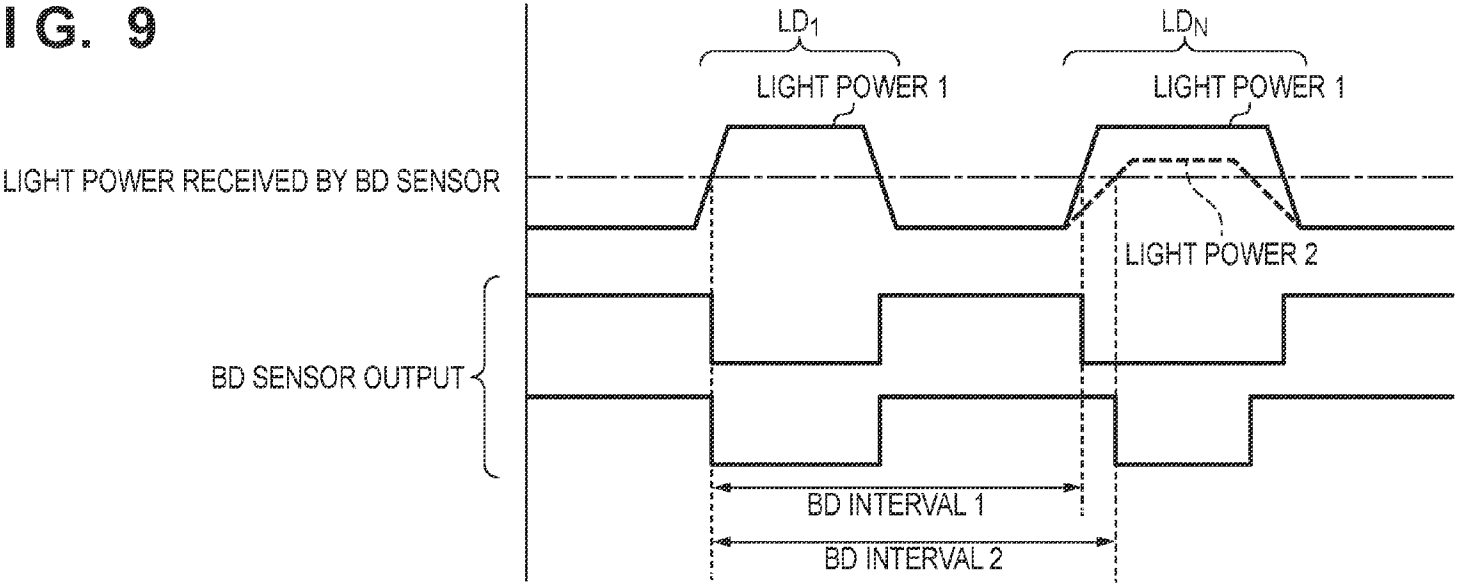
FIG. 9 is a diagram showing an example of a relationship between light power received by the BD sensor and BD intervals.

Here, FIG. 9 is a diagram showing an example of the relationship between the light power of the light beam received by the BD sensor 207 and the BD interval. The response speed of the BD sensor 207 when a laser beam is incident on the BD sensor 207 changes according to the light power of the incident light beam. For this reason, if the light power of the light beam incident on the BD sensor 207 changes, there is a possibility that an error will occur in the result of measuring the time interval (BD interval) between the pulses (BD signals) generated by the BD sensor 207. In FIG. 9, if the light power of the light beam received by the BD sensor 207 of the laser beam emitted from the light emitting element N ($LD_N$) changes from a light power 1 to a light power 2, the measured BD interval changes from a BD interval 1 to a BD interval 2. This is because the rising speed and the falling speed of the pulse corresponding to the BD signal generated by the BD sensor 207 (i.e., the response speed of the BD sensor 207) are dependent on the light power of the light beam received by the BD sensor 207.

If an error occurs in the BD interval measurement result due to this kind of change in the light power of the light beam received by the BD sensor 207, it will no longer be possible to appropriately control laser emission timings for the light emitting elements. For this reason, in the present embodiment, when performing BD interval measurement (modes 1 and 2), in order to set the light power of the light beam received by the BD sensor 207 to be constant, the light power for BD interval measurement is set to a constant pre-determined light power for the light emitting elements 1 and 32 (steps S121 and S141).

Next, in step S122, the CPU 401 controls the laser driver 200 so as to cause the light emitting element 1 to be turned on with the set light power, and in step S123, the CPU 401 determines whether or not the BD signal has been detected in the input signal from the BD sensor 207. If it is determined that the BD signal has not been detected, the CPU 401 repeats the determination processing of step S123. On the other hand, if it is determined that the BD signal has been detected, the CPU 401 advances the process to step S124. In step S124, the CPU 401 starts counting the pulses of the CLK signal input from the CLK signal generator 404 using the detected BD signal as the starting point.

Next, in step S125, the CPU 401 controls the laser driver 200 so as to cause the light emitting element 32 to be turned on with the set light power, and in step S126, the CPU 401 determines whether or not the BD signal has been detected in the input signal from the BD sensor 207. If it is determined that the BD signal has not been detected, the CPU 401 repeats the determination processing of step S126. On the other hand, if it is determined that the BD signal has been detected, the CPU 401 advances the process to step S127. In step S127, the CPU 401 stores the count value (measurement value) Cs at the time when the BD signal is detected in the memory 406 and advances the process to step S128. Note that the count value Cs corresponds to the measurement value of the time interval (BD interval) between the two BD signals corresponding to the light emitting elements 1 and 32.

In step S128, the CPU 401 determines whether or not BD interval measurement have been executed a predetermined first number of times (in the present embodiment, 1000 is set to the predetermined first number as an example). That is to say, the CPU 401 determines whether or not 1000 count values (measurement values) Cs have been obtained. If it is determined in step S128 that 1000 count values Cs have not been obtained, the CPU 401 returns the process to step S122 and repeats BD interval measurement by executing the processing of steps S122 to S128 once again. On the other hand, if it is determined in step S128 that 1000 count values Cs have been obtained, the CPU 401 advances the process to step S129.

Finally, in step S129, the CPU 401 generates (sets) the correction values $As_1$ to $As_{32}$ for correcting the writing start positions of the electrostatic latent images in the main scanning direction based on the BD interval measurement result. In the present embodiment, the CPU 401 obtains the average value of the 1000 count values as the measurement value and uses Equation (2) to generate the correction values $As_1$ to $As_{32}$ based on the average value and the reference count value Cr that is stored in advance in the memory 406. By applying the generated correction values $As_1$ to $As_{32}$ to Equation (1), the CPU 401 determines the light emission start timing values $A_1$ to $A_{32}$ that are to be set for the light emitting elements 1 to 32. According to the above procedure, the CPU 401 completes BD interval measurement according to BD interval measurement mode 1 and advances the process to step S106 (FIG. 11).

When the BD interval measurement according to BD interval measurement mode 1 is complete, the CPU 401 determines in step S106 whether or not an image formation job has been input to the central image processor 130. If it is determined that an image formation job has been input, the CPU 401 advances the process to step S107, and if it is determined that an image formation job has not been input, the CPU 401 causes the optical scanning unit 104 (image forming apparatus 100) to transition to the standby mode.

(Image Formation Processing)

Figure 14:
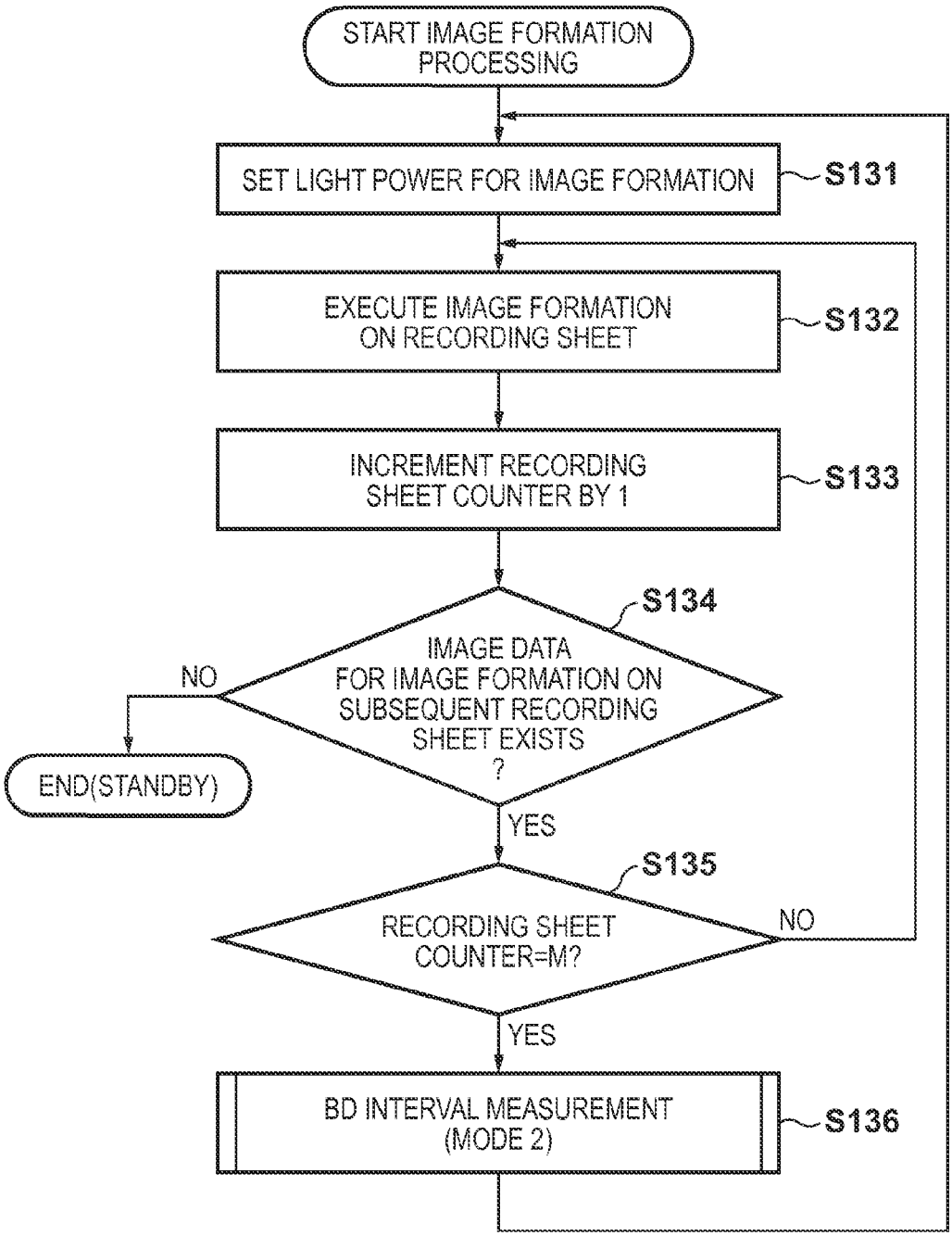
FIG. 14 is a flowchart showing a procedure of image formation processing according to Embodiment 1.

In step S107, the CPU 401 executes image formation processing in accordance with the procedure shown in FIG. 14. In the image formation processing according to the present embodiment, BD interval measurement (mode 2) is executed periodically in order to compensate for misalignments among the image forming positions $S_1$ to $S_N$ caused by temperature changes in the light emitting elements and the like. Specifically, when image formation is to be performed on multiple recording sheets, each time image formation on a predetermined number of recording sheets (M sheets) is performed, the CPU 401 executes BD interval measurement (mode 2) in a non-image-forming period up to when the image formation on the next recording sheet is started. Note that when the execution of image formation processing is started, the CPU 401 resets a built-in recording sheet counter to 0.

In step S131, the CPU 401 sets the light power of the laser beams emitted from the light emitting elements 1 to 32 to the light power for image formation. Next, in step S132, the CPU 401 executes image formation on one recording sheet based on the image data input to the scanner unit controller 210 from the central image processor 130.

Specifically, the CPU 401 controls the laser driver 200 so as to cause the light emitting elements to be turned on at the light power that has been set in step S131. At this time, the CPU 401 controls the times at which the light emitting elements emit the laser beams based on the image data by setting $A_1$ to $A_{32}$ that have been set in step S129 in the image output controller 405. Note that the image output controller 405 outputs the laser drive pulse signals corresponding to the image data to the laser driver 200 at timings in accordance with $A_1$ to $A_{32}$. The laser driver 200 causes laser beams based on the image data to be emitted from the light emitting elements by supplying driving currents based on the laser drive pulse signals to the respective light emitting elements.

Upon completing image formation with respect to one recording sheet, the CPU 401 increments the built-in recording sheet counter by 1 in step S133. Furthermore, in step S134, the CPU 401 determines whether or not the image data for image formation on a subsequent recording sheet exists. If it is determined that image data does not exist, the CPU 401 causes the optical scanning unit 104 (image forming apparatus 100) to transition to the standby mode, and if it is determined that image data does exist, the CPU 401 advances the process to step S135.

Figure 16:
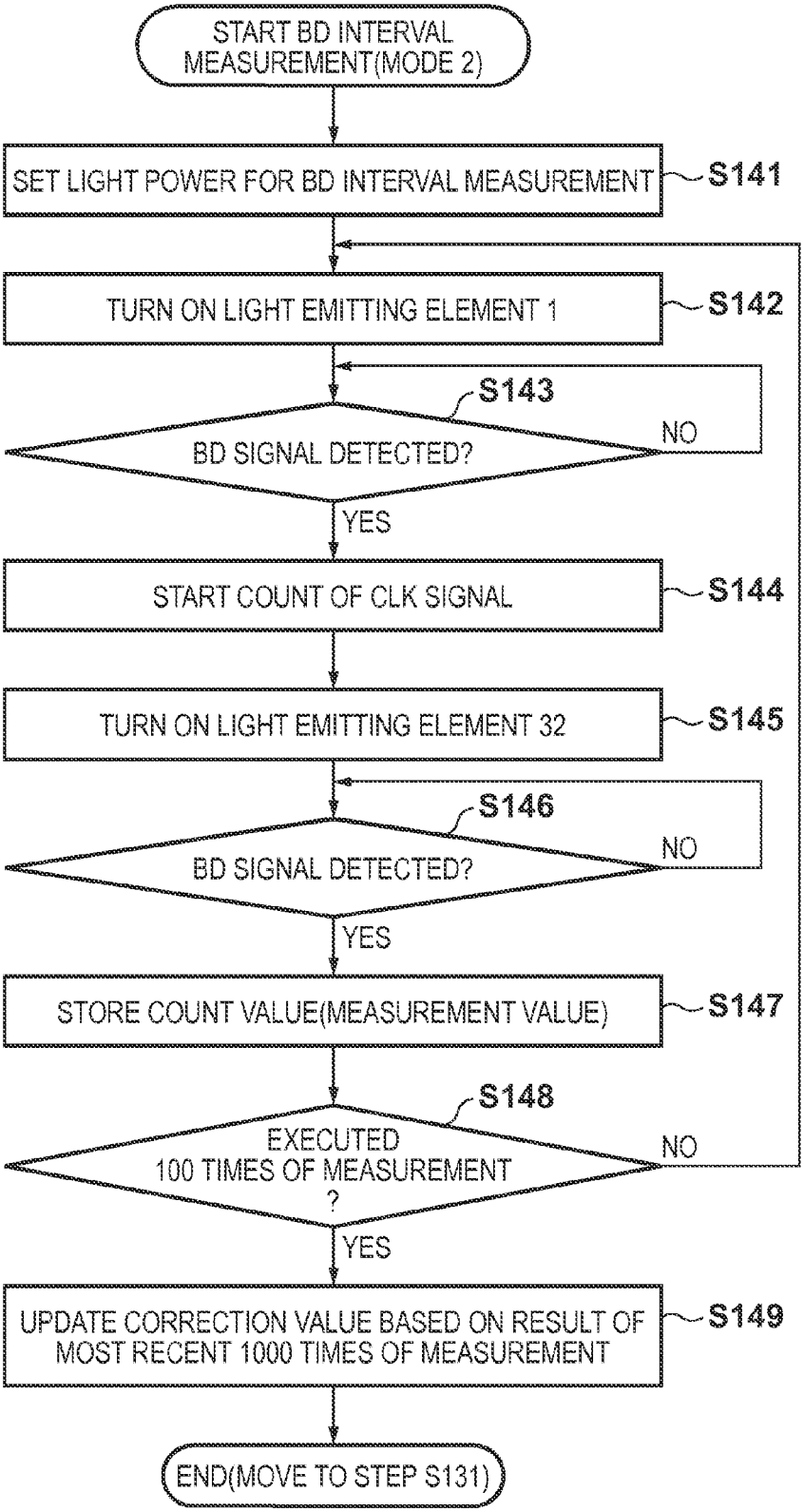
FIG. 16 is a flowchart showing a procedure of BD interval measurement (mode 2) according to Embodiment 1.

In step S135, the CPU 401 determines whether or not the recording sheet counter is at a set value M. If it is determined that the recording sheet counter is not at M, the CPU 401 returns the process to step S132 in order to form an image on the next recording sheet. On the other hand, if it is determined that the recording sheet counter is at M, the CPU 401 advances the process to step S136 and executes BD interval measurement of mode 2 (FIG. 16). $A_1$ to $A_{32}$ are updated according to the BD interval measurement.

Upon completing the BD interval measurement (mode 2) in step S136, the CPU 401 resets the recording sheet counter to 0 and returns the process to step S131 in order to form an image on the next recording sheet. Note that in step S132, image formation is performed using $A_1$ to $A_{32}$ updated in step S136, instead of the $A_1$ to $A_{32}$ determined in step S129.

(BD Interval Measurement Mode 2)

Figure 15A:
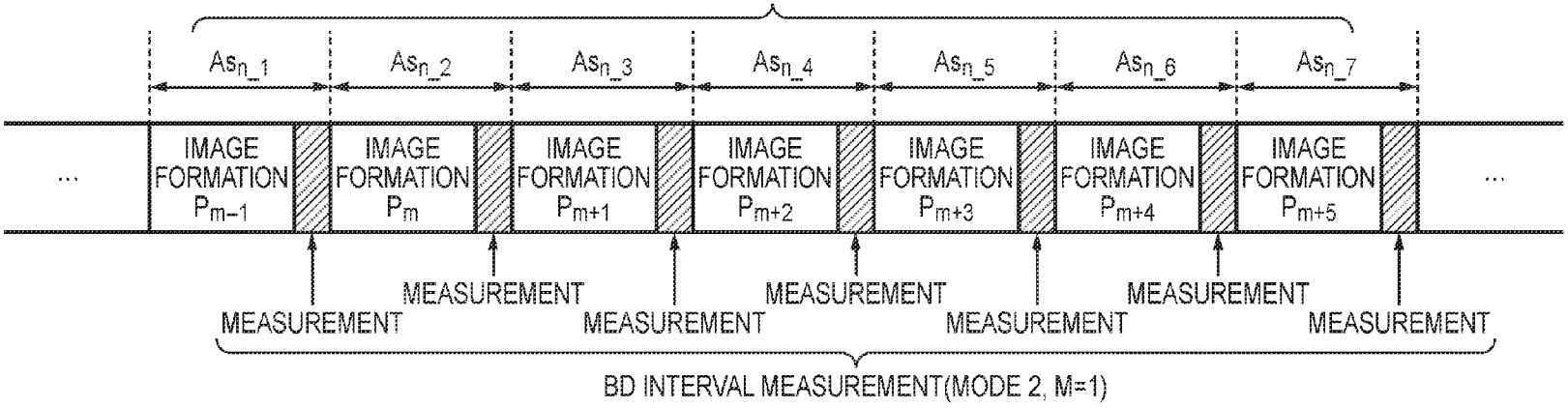
FIGS. 15A and 15B are diagrams showing an example of the execution timing for BD interval measurement (mode 2) according to Embodiment 1.
Figure 15B:
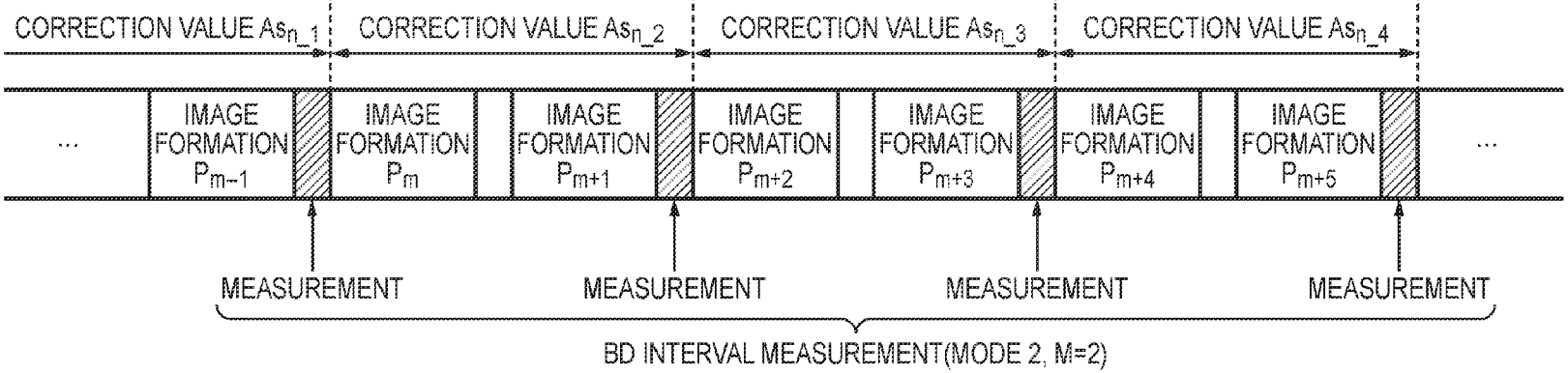

Here, the timing of executing BD interval measurement (mode 2) according to the present embodiment will be described with reference to FIGS. 15A and 15B. FIGS. 15A and 15B show that each time image formation with respect to M recording sheets P is executed, the BD interval measurement is executed according to BD interval measurement mode 2. FIG. 15A shows the case where M=1, and in this case, each time image formation with respect to 1 recording sheet P is completed, BD interval measurement is executed in the non-image-forming period before the image formation with respect to the next recording sheet P is started. Also, FIG. 15B shows the case where M=2, and in this case, each time image formation with respect to 2 recording sheets P is completed, BD interval measurement is executed in the non-image-forming period before the image formation with respect to the next recording sheet P is started.

In the present embodiment, M can be set to any natural number. In accordance with the set M, the CPU 401 periodically executes BD interval measurement while image formation is being executed with respect to multiple recording sheets. According to this, it is possible to sequentially update the correction values $As_1$ to $As_N$ while image formation is being executed, and therefore it is possible to control the timings at which the laser beams are emitted from the light emitting elements 1 to 32 so as to follow a temperature change in a light emitting element or the like.

In step S136, BD interval measurement according to BD interval measurement mode 2 is executed in accordance with the procedure shown in FIG. 16. In steps S141 to S147 shown in FIG. 16, the CPU 401 executes processing that is similar to that of steps S121 to S127 in the BD interval measurement according to BD interval measurement mode 1 (FIG. 13). Accordingly, in step S147, the CPU 401 stores the count value Cs corresponding to the measurement result of the BD interval measurement (measurement value) in the memory 406 and advances the process to step S148.

In step S148, the CPU 401 determines whether or not BD interval measurement have been executed a predetermined second number of times (in the present embodiment, 100 is set to the predetermined second number as an example). That is to say, the CPU 401 determines whether or not 100 count values (measurement values) Cs have been obtained. If it is determined in step S148 that 100 count values Cs have not been obtained, the CPU 401 repeats the BD interval measurement by returning the process to step S142 and executing the processing of steps S142 to S148 once again. On the other hand, if it is determined in step S148 that 100 count values Cs have been obtained, the CPU 401 advances the process to step S149.

In step S149, the CPU 401 updates the correction values $As_1$ to $As_{32}$ based on the 1000 most recent count values (measurement values) Cs that have been obtained according to the most recent first number of times of BD interval measurement. Specifically, based on the averaged value of the 1000 most recent count values Cs and the reference count value Cr that is stored in advance in the memory 406, the CPU 401 generates (updates) the correction values $As_1$ to $As_{32}$ using Equation (2). Furthermore, by applying the updated correction values $As_1$ to $As_{32}$ to Equation (1), the CPU 401 updates the light emission start timing values $A_1$ to $A_{32}$ that are to be set for the light emitting elements 1 to 32.

In the above-described processing, the average value of the count values obtained by measurement in the present non-image-forming period and the count values obtained by measurement in past non-image-forming periods is obtained as the measurement value, and $A_1$ to $A_{32}$ are updated based on the measurement value. In this kind of averaging processing, the correction values $As_1$ to $As_{32}$ and $A_1$ to $A_{32}$ can be updated so as to follow a temperature change in a light emitting element and the like, by averaging the measurement values within a limited time range (in the present embodiment, the time range in which the most recent 1000 times of BD interval measurement were performed). Note that if the predetermined second number of times is equal to the predetermined first number of times (i.e., 1000 times), $A_1$ to $A_{32}$ may be updated based on the average value of the count values obtained in the predetermined first number of times of BD interval measurement that have been performed in one non-image-forming period.

According to the above procedure, the CPU 401 completes the BD interval measurement (mode 2) and returns the process to step S131 (FIG. 14) in order to form an image on the next recording sheet.

As described above, in the present embodiment, the CPU 401 controls the light source 201 such that laser beams are sequentially incident on the BD sensor 207 from the light emitting elements 1 and N in a non-image-forming period, and the CPU 401 measures the time interval between the two BD signals output sequentially from the BD sensor 207. Specifically, each time image formation is performed on a predetermined number of recording sheets (M sheets), the CPU 401 executes BD interval measurement in a non-image-forming period until image formation for the next recording sheet is started. When image formation is to be performed subsequent to the non-image-forming period, the CPU 401 controls the light source 201 such that a laser beam from the light emitting element 1 is incident on the BD sensor 207. Furthermore, the CPU 401 uses the single BD signal output from the BD sensor 207 as a reference to control the timings at which the light emitting elements output laser beams based on the image data, according to the measurement value of the BD interval measurement that is executed periodically in non-image-forming periods.

According to the present invention, during the execution of image formation, the measurement values of the BD interval measurement can be updated sequentially so as to follow a temperature change in a light emitting element and the like. As a result, even if this kind of temperature change occurs, the laser emission timings can be accurately controlled so as to coincide the writing start positions, in the main scanning direction, of the electrostatic latent images that are formed by the laser beams emitted from the light emitting elements.

Embodiment 2

In Embodiment 1, BD interval measurement is executed periodically during non-image-forming periods in which image formation is not performed. However, it is possible that the non-image-forming periods shorten due to the frequency of BD interval measurement being decreased to the greatest extent possible, thereby increasing the productivity of the image forming apparatus 100. Also, if the frequency of BD interval measurement is decreased, the light emission accumulation times of the light emitting elements 1 and N (=32) shorten, and it is thereby possible to extend the life of the light emitting elements. In view of this, in Embodiment 2, the properties of the optical scanning unit 104, which are related to a change in the BD interval measurement values while image formation is performed on multiple recording sheets, are used to reduce the frequency of BD interval measurement, and thereby the productivity of the image forming apparatus 100 is raised and the lifespan of the light emitting elements is extended.

Figure 10:
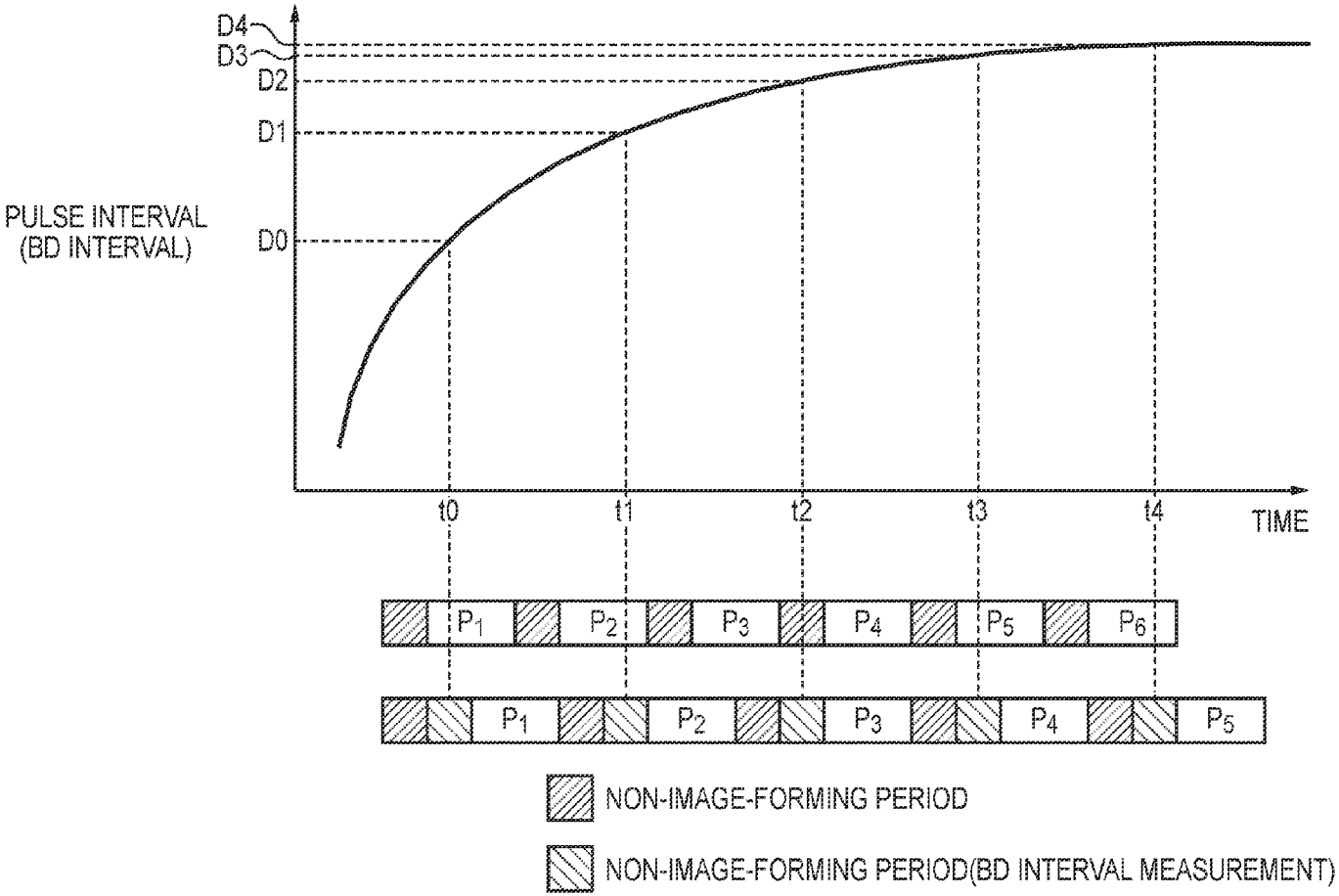
FIG. 10 is a diagram showing an example of change in BD intervals which is associated with the execution of image formation.

FIG. 10 is a diagram showing an example of a change in the BD interval which is associated with the execution of image formation subsequent to an image formation job being input to the image forming apparatus 100. FIG. 10 shows a change in a BD interval Dm that is obtained by performing BD interval measurement at a time tm in non-image-forming periods while image formation is being performed successively with respect to recording sheets Pm (m=0, 1, 2, . . . ). Note that FIG. 10 also shows a processing sequence in a case of performing BD interval measurement and in a case of not performing BD interval measurement. As shown in FIG. 10, in the case of performing BD interval measurement in non-image-forming periods each time image formation on the recording sheets is completed, non-image-forming periods increase in number and the productivity decreases compared to the case of not performing BD interval measurement.

However, as shown in FIG. 10, after image formation on the recording sheets is started, the amount of change in the BD interval gradually decreases as time elapses, and the BD interval ultimately becomes saturated at a constant value. For this reason, in accordance with the amount of time that has elapsed since starting image formation, it is possible to reduce the frequency of the BD interval measurement while suppressing degradation of the accuracy of laser emission timing control. In the present embodiment, when image formation on multiple recording sheets is to be performed using this kind of property of the optical scanning apparatus 104, the interval between the times of executing BD interval measurement is increased according to the number of accumulated recording sheets that have been subjected to image formation. According to this, as time elapses from the start of execution of the image formation job, the frequency of BD interval measurement is reduced.

In the present embodiment, similarly to Embodiment 1, the CPU 401 executes the processing in accordance with the procedure shown in FIG. 11 when the power source of the image forming apparatus 100 is started from a stopped state, or when returning from a standby state. Note that in step S107, the CPU 401 executes image formation processing in accordance with the procedure shown in FIG. 17 rather than the procedure shown in FIG. 14. In order to avoid repetitive description, description of portions in common with Embodiment 1 will be omitted below.

(Image Forming Processing)

Figure 17:
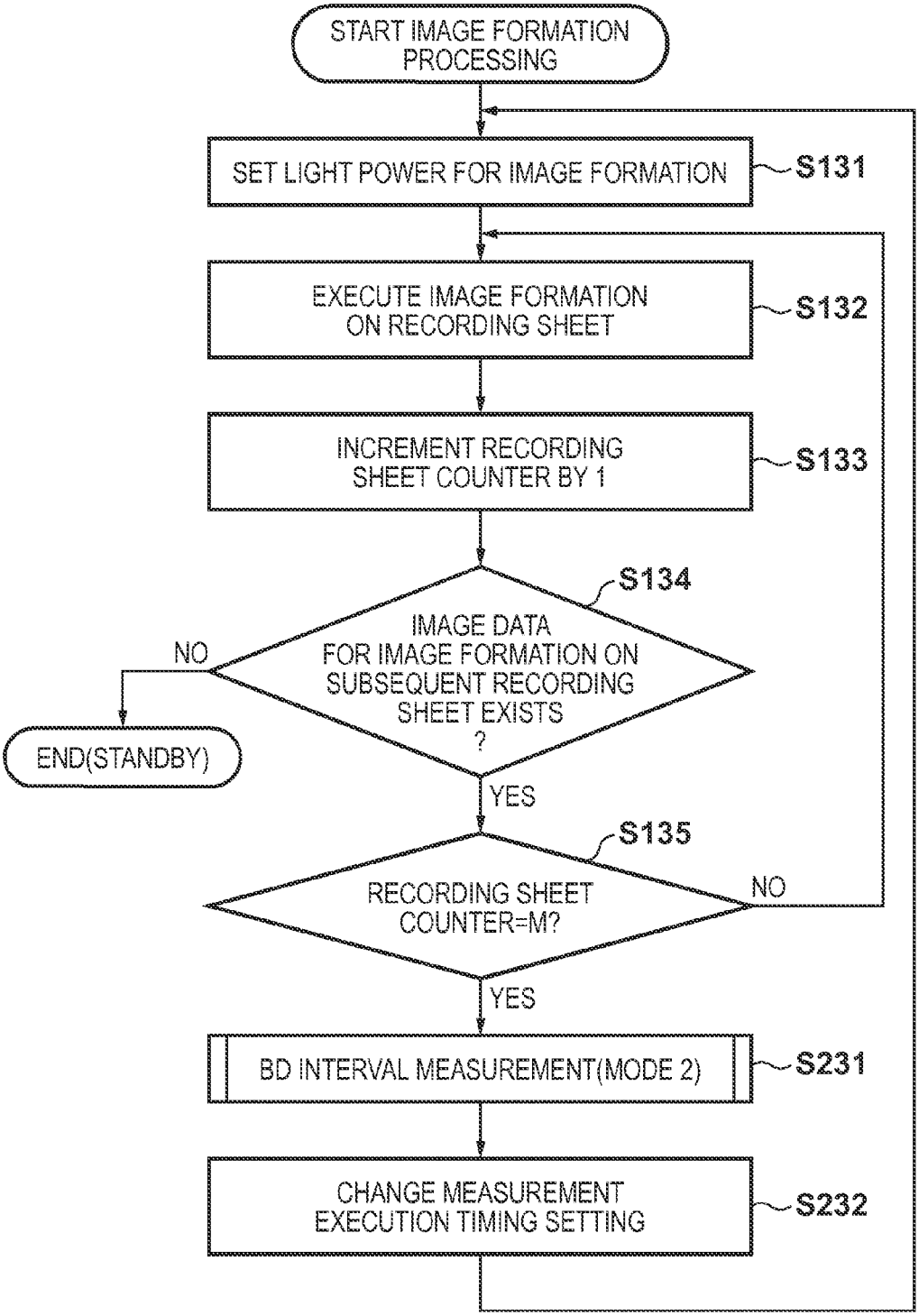
FIG. 17 is a flowchart showing a procedure of image formation processing according to Embodiment 2.
Figure 20:
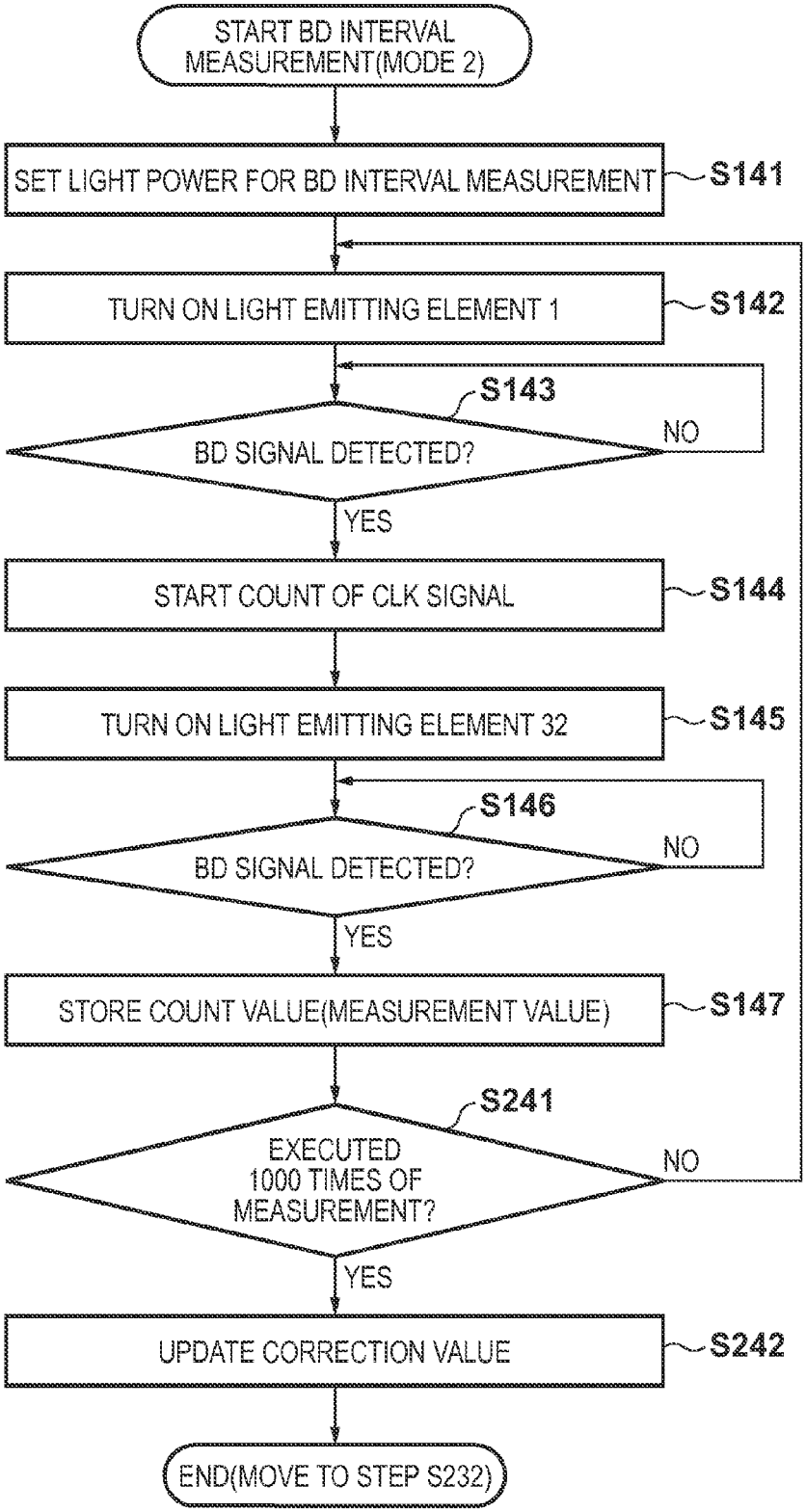
FIG. 20 is a flowchart showing a procedure of BD interval measurement (mode 2) according to Embodiment 2.

In the image formation processing according to the present embodiment shown in FIG. 17, while image formation on the recording sheets is being executed, the execution interval of the BD interval measurement (mode 2) is gradually increased according to the number of accumulated recording sheets that have been subjected to image formation. First, when the execution of image formation processing is started, the CPU 401 resets the built-in recording sheet counter to 0 and executes steps S131 to S135, similarly to Embodiment 1 (FIG. 14). In step S135, if it is determined that the recording sheet counter is not at M, the CPU 401 returns the process to step S132 in order to perform image formation on the next recording sheet. On the other hand, if it is determined that the recording sheet counter is at M, the CPU 401 advances the process to step S231 and executes BD interval measurement of mode 2 (FIG. 20).

Upon completing the BD interval measurement (mode 2) in step S231, the CPU 401 advances the process to step S232 and changes the setting value M, which is the setting value for the number of recording sheets and indicates the timing at which the next BD interval measurement (mode 2) is to be executed, to a larger value.

(Processing for Changing the Setting Value M)

The processing of step S232 can be realized by storing a table 1800 shown in FIG. 18 in the memory 406 in advance, for example. Values stored in a register built into the CPU 401 and the setting value M of the execution timing of BD interval measurement are held in association in the table 1800. The setting value M held in the table 1800 indicates the number of recording sheets on which images have been formed from when BD interval measurement (step S105 or S231) was previously executed, until when BD interval measurement (step S231) is to be executed subsequently. Note that the setting value M (=20) corresponding to the register value 0 is the initial value, and when image formation processing is started, it is read from the table 1800 by the CPU 401 and used.

Each time the recording sheet counter reaches the set value M in step S135, the CPU 401 increments the register value by 1 and newly reads out the setting value M that is associated with the register value from the table 1800 in step S232. For example, if the register value is incremented from 0 to 1, in step S232, the CPU 401 changes the setting value M to the read-out value by reading out the setting value 40 associated with the register value 1 from the table 1800.

In the present embodiment, as shown in FIG. 18, the setting value M is changed to a larger value as the register value increases. For example, upon forming images with respect to 20 recording sheets after the BD interval measurement (mode 1 ) in step S105, the CPU 401 executes BD interval measurement (mode 2) in step S231. Upon forming images with respect to 40 recording sheets after completing the BD interval measurement (mode 2), the CPU 401 executes BD interval measurement (mode 2) in step S231 once again.

In this way, in the present embodiment, the interval between the times of executing BD interval measurement is increased as the number of accumulated recording sheets subjected to image formation increases. After completing step S232, the CPU 401 returns the process to step S131 in order to form an image on the next recording sheet. Note that similarly to Embodiment 1, the recording sheet counter is reset after executing the BD interval measurement in step S136 and before starting the image formation with respect to the next recording sheet.

(BD Interval Measurement Mode 2)

Next, the timing of executing BD interval measurement (mode 2) according to the present embodiment will be described with reference to FIG. 19A. In the present embodiment, similarly to Embodiment 1, each time the recording sheet counter reaches M, the CPU 401 executes BD interval measurement (mode 2). After repeatedly executing the predetermined first number of times (1000 is set to the predetermined first number as an example, similarly to Embodiment 1) of BD interval measurement in a non-image-forming period corresponding to the timing of executing BD interval measurement, the CPU 401 once again executes image formation on a recording sheet.

Figure 19A:
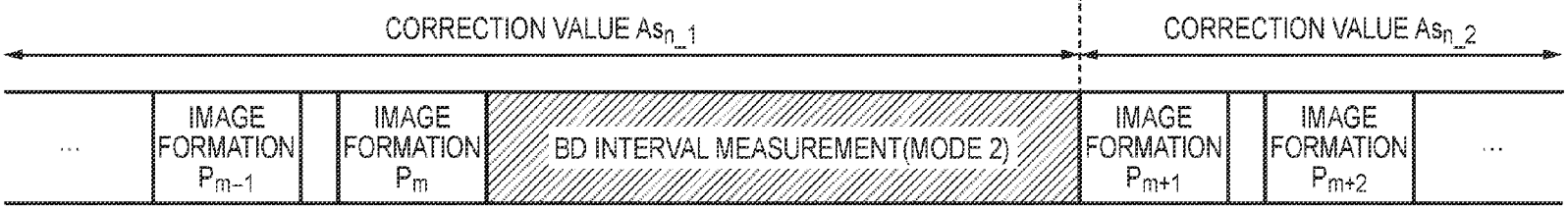
FIGS. 19A and 19B are diagrams showing an example of the execution timing for BD interval measurement (mode 2) according to Embodiment 2.

As shown in FIG. 19A, image formation using laser emission timing control to which the correction value $A_{n_1}$ is applied, is executed on M recording sheets until recording sheet $P_m$, and thereafter BD interval measurement (mode 2.) is executed. As a result of the BD interval measurement, the correction value is updated from $A_{n_1}$ to $A_{n_2}$. Thereafter, the laser emission timing control to which the correction value $A_{n_2}$ has been applied is used in the image formation with respect to M recording sheets after recording sheet $P_{n+1}$.

In step S231, the CPU 401 executes BD interval measurement (mode 2) in accordance with the procedure shown in FIG. 20. In steps S141 to S147 shown in FIG. 20, the CPU 401 executes processing that is similar to that of steps S121 to S127 in the BD interval measurement (mode 1 ) (FIG. 13). According to this, in step S147, the CPU 401 stores the count values (measurement values) corresponding to the measurement result of the BD interval measurement in the memory 406 and advances the process to step S241.

In step S241, the CPU 401 determines whether or not BD interval measurement have been executed a predetermined first number of times (1000 times). That is to say, the CPU 401 determines whether or not 1000 count values (measurement values) Cs have been obtained. If it is determined in step S241 that 1000 count values have not been obtained, the CPU 401 returns the process to step S142 and repeats BD interval measurement by executing the processing of steps S142 to S147 and S241 once again. On the other hand, if it is determined in step S241 that 1000 count values have been obtained, the CPU 401 advances the process to step S242.

In step S242, the CPU 401 updates the correction values $As_1$ to $As_{32}$ based on the 1000 count values (measurement values) Cs obtained by 1000 times of BD interval measurement. Specifically, based on the averaged value of the 1000 count values Cs and the reference count value Cr that is stored in advance in the memory 406, the CPU 401 generates (updates) the correction values $As_1$ to $As_{32}$ using Equation (2). Furthermore, by applying the updated correction values $As_1$ to $As_{32}$ to Equation (1), the CPU 401 updates the light emission start timing values $A_1$ to $A_{32}$ that are to be set for the light emitting elements 1 to 32.

According to the above procedure, the CPU 401 completes BD interval measurement (mode 2) and advances the process to step S232 (FIG. 17) in order to change the setting value M to a larger value.

As described above, in the present embodiment, when image formation on multiple recording sheets is to be performed, the interval between the times of executing BD interval measurement is increased by the CPU 401 according to the number of accumulated recording sheets that have been subjected to image formation. According to this, the frequency of BD interval measurement can be reduced, and therefore it is possible to further increase the productivity of the image forming apparatus 100 and to extend the lifespan of the light emitting elements used in the BD interval measurement.

Embodiment 3

Embodiment 3 is a variation of Embodiment 2, and the operation of the optical scanning unit 104 in BD interval measurement (mode 2) differs from that of Embodiment 2. In the present embodiment, upon reaching the time of executing BD interval measurement (mode 2), BD interval measurement in the non-image-forming period and image formation on a recording sheet are alternatingly executed until a predetermined number of times of BD interval measurement are complete. Note that in order to avoid repetitive description, description of portions in common with Embodiments 1 and 2 will be omitted below.

Figure 19B:
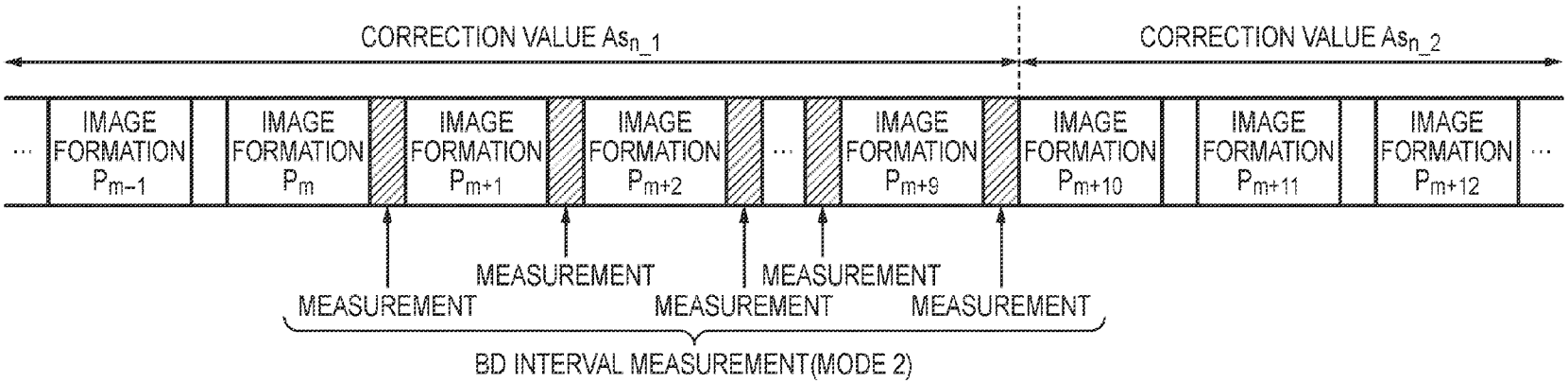

The timing of executing BD interval measurement (mode 2) according to the present embodiment will be described below with reference to FIG. 19B. In the present embodiment, similarly to Embodiments 1 and 2, each time the recording sheet counter reaches M, the CPU 401 executes BD interval measurement (mode 2). In the present embodiment, upon reaching the time of executing the BD interval measurement (mode 2), as shown in FIG. 19B, image formation on the recording sheet P is continued, and BD interval measurement is executed in a non-image-forming period between a period of image formation on a recording sheet and a period of image formation on a subsequent recording sheet. Also, a predetermined number of times (1000 is set to the predetermined number as an example, similarly to Embodiments 1 and 2) of BD interval measurement are executed, for example, 100 times at a time, in multiple non-image-forming periods.

FIG. 19B shows a case in which the total 1000 times of BD interval measurement are divided by 10 times, and 100 times of BD interval measurement are executed in each non-image-forming period. Specifically, when the recording sheet counter reaches M, which corresponds to the image formation on the recording sheet $P_m$, the time of executing BD interval measurement (mode 2) is reached. Upon starting the execution of the BD interval measurement (mode 2), the CPU 401 performs 100 times of BD interval measurement and obtains 100 count values Cs. Next, after executing image formation on the next recording sheet $P_{m+1}$, the CPU 401 once again performs 100 times of BD interval measurement and obtains 100 count values Cs. By doing this, the CPU 401 obtains a total of 1000 count values Cs by performing 100 times of BD interval measurement after executing image formation on the recording sheet $P_{m+9}$. Note that in the image formation on M recording sheets until the recording sheet $P_{m+9}$, the CPU 401 performs laser emission timing control to which the correction value $As_{n_1}$ is applied.

Thereafter, the CPU 401 updates the correction values from $As_{n_1}$ to $As_{n_2}$ based on the 1000 total count values (measurement values) Cs. Furthermore, in image formation with respect to M recording sheets following the recording sheet $P_{m+10}$, the CPU 401 performs laser emission timing control to which the correction value $As_{n_2}$ is applied.

Figure 21:
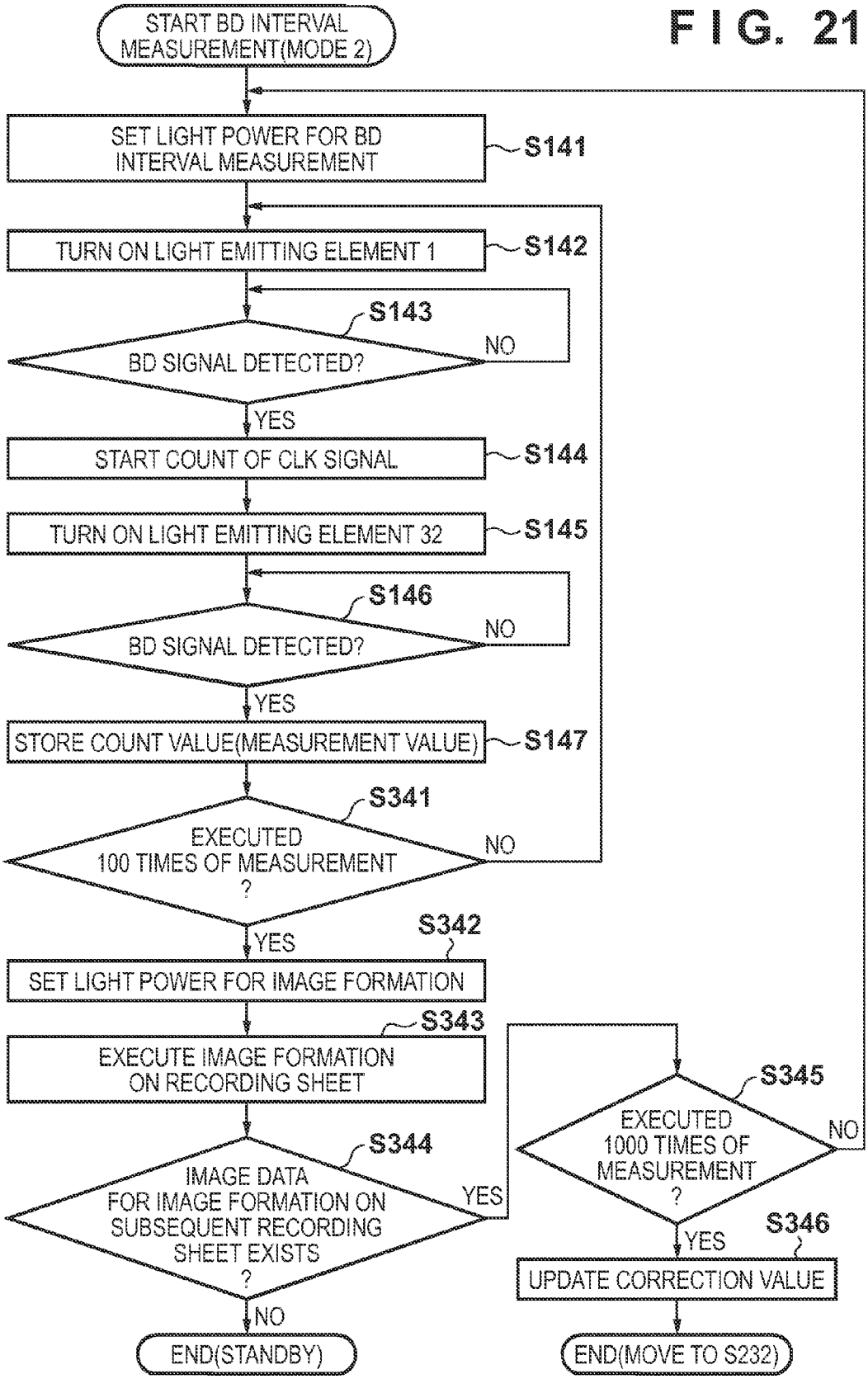
FIG. 21 is a flowchart showing a procedure of BD interval measurement (mode 2) according to Embodiment 3.

In step S231, the CPU 401 executes BD interval measurement (mode 2) in accordance with the procedure shown in FIG. 21. In steps S141 to S147 shown in FIG. 21, similarly to Embodiments 1 and 2, the CPU 401 executes processing similar to that of steps S121 to S127 (FIG. 13) in the BD interval measurement (mode 1 ). According to this, in step S147, the CPU 401 stores the count values (measurement values) corresponding to the measurement result of the BD interval measurement in the memory 406 and advances the process to step S341.

In step S341, the CPU 401 determines whether or not 100 times of BD interval measurement have been executed. That is to say, the CPU 401 determines whether or not 100 count values (measurement values) Cs have been obtained. If it is determined in step S341 that 100 count values Cs have not been obtained, the CPU 401 repeats the BD interval measurement by returning the process to step S142 and executing the processing of steps S142 to S147 and S341 once again. On the other hand, if it is determined in step S341 that 100 count values Cs have been obtained, the CPU 401 advances the process to step S342.

In step S342, the CPU 401 sets the light power of the laser beams emitted by the light emitting elements 1 to 32 to the light power for image formation. Next, in step S343, the CPU 401 executes image formation on one recording sheet based on the image data input to the scanner unit controller 210 from the central image processor 130. Upon completing image formation, the CPU 401 determines in step S344 whether or not image data for image formation on a subsequent recording sheet exists. If it is determined that image data does not exist, the CPU 401 causes the optical scanning unit 104 (image forming apparatus 100) to transition to the standby mode, and if it is determined that image data does exist, the CPU 401 advances the process to step S345.

In step S345, the CPU 401 determines whether or not a predetermined first number of times (1000 times) of BD interval measurement have been executed. That is to say, the CPU 401 determines whether or not 1000 count values (measurement values) Cs have been obtained. If it is determined in step S345 that 1000 count values Cs have not been obtained, the CPU 401 returns the process to step S141 and repeats the image formation and the BD interval measurement by once again executing the processing of steps S141 to S147 and steps S341 to S345. On the other hand, if it is determined in step S345 that 1000 count values Cs have been obtained, the CPU 401 advances the process to step S346.

In step S346, similarly to step S242 (FIG. 20), the CPU 401 updates the correction values $As_1$ to $As_{32}$ based on the 1000 count values (measurement values) obtained by the 1000 times of BD interval measurement.

According to the above procedure, the CPU 401 completes BD interval measurement (mode 2) and advances the process to step S232 (FIG. 17) in order to change the setting value M to a larger value.

As described above, in the present embodiment, similarly to Embodiment 2, when image formation on multiple recording sheets is to be performed, the interval between the times of executing BD interval measurement is increased according to the number of accumulated recording sheets that have been subjected to image formation. According to this, similarly to Embodiment 2, the frequency of BD interval measurement can be reduced, and therefore it is possible to further increase the productivity of the image forming apparatus 100 and to extend the lifespan of the light emitting elements used in the BD interval measurement.

Embodiment 4

In Embodiments 2 and 3, when image formation on multiple recording sheets is performed, the interval between the times of executing BD interval measurement is increased according to the number of accumulated recording sheets that were subjected to image formation. Embodiment 4 is a variation of Embodiments 2 and 3, in which the interval between times of executing BD interval measurement is increased according to the amount of change in the temperature of the scanner unit controller 210 rather than the number of accumulated recording sheets.

In general, during the execution of image formation, the amount of change of the temperature of a light emitting element (optical scanning unit 104) decreases with time, and when a certain amount of time elapses, the temperature converges at a constant temperature and enters a state of equilibrium. The present embodiment makes use of this kind of property of a light emitting element. Specifically, after starting image formation on a recording sheet, each time the temperature of the optical scanning unit 104 changes by a predetermined amount from the previous instance of performing BD interval measurement, the next BD interval measurement is executed. In this case, the amount of change of the temperature of the optical scanning unit 104 decreases with time, and it is therefore possible to increase the interval between times of executing BD interval measurement as time elapses, similarly to Embodiments 2 and 3. Note that in order to avoid repetitive description, description of portions in common with Embodiments 1 to 3 will be omitted below.

Figure 22:
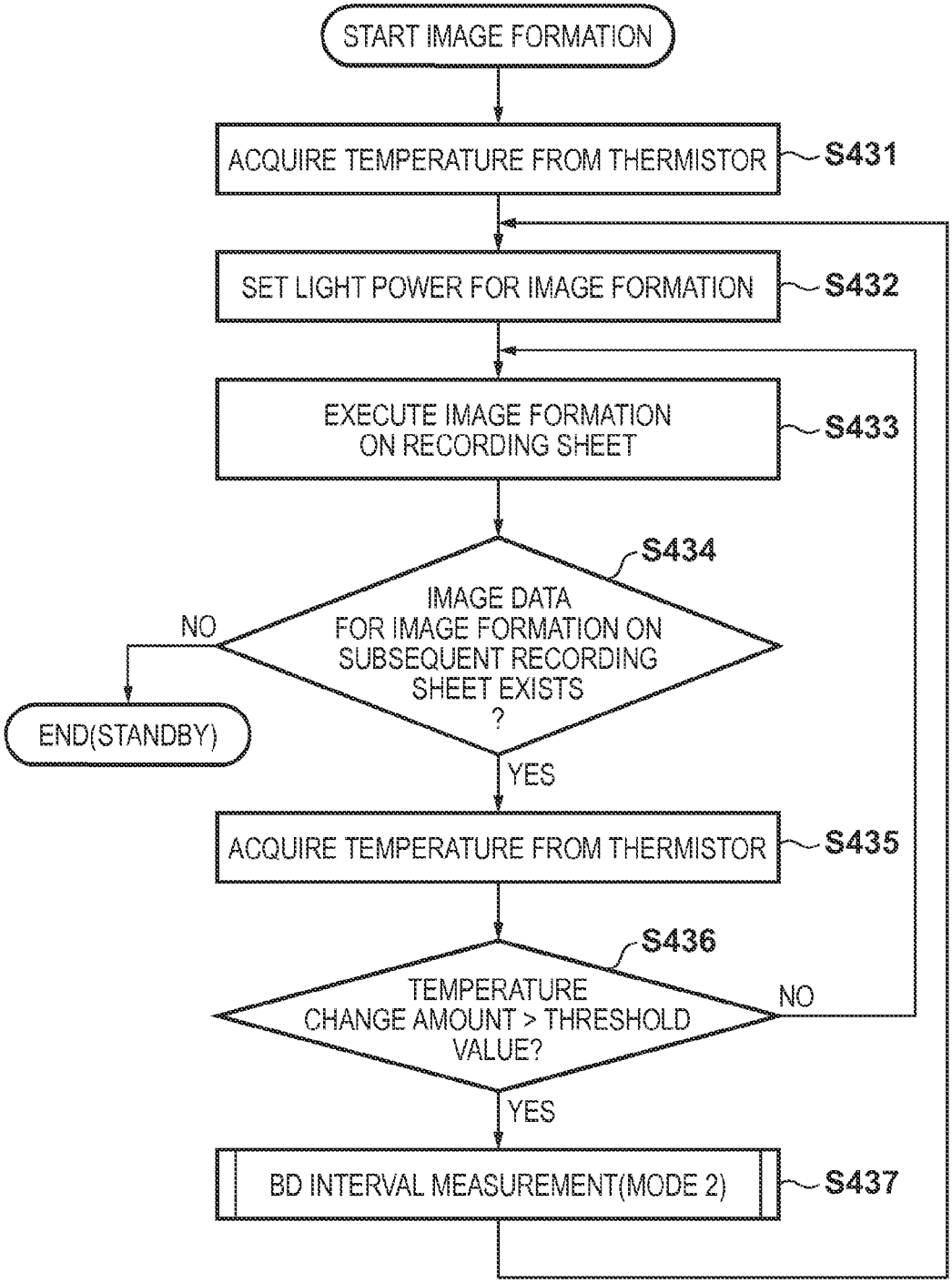
FIG. 22 is a flowchart showing a procedure of image formation processing according to Embodiment 4.

In the present embodiment, similarly to Embodiment 1, the CPU 401 executes the processing in accordance with the procedure shown in FIG. 11 when the power source of the image forming apparatus 100 is started from a stopped state, or when returning from a standby state. Note that in step S107, the CPU 401 executes image formation processing in accordance with the procedure shown in FIG. 22 rather than the procedures shown in FIGS. 14 and 17. Note that the recording sheet counter used in Embodiments 1 to 3 is not needed in the present embodiment.

(Image Forming Processing)

Upon starting the execution of image formation processing, in step S431, the CPU 401 first acquires the temperature of the scanner unit controller 210 that has been measured by the thermistor 410 and stores it in the memory 406 as a temperature measurement value $Tp_1$.

Next, in step S432, the CPU 401 sets the light power of the laser beams emitted from the light emitting elements 1 to 32 to the light power for image formation. Next, in step S433, the CPU 401 executes image formation on one recording sheet based on the image data input to the scanner unit controller 210 from the central image processor 130. Upon completing image formation with respect to one recording sheet, in step S434, the CPU 401 determines whether or not image data for image formation on a subsequent recording sheet exists. If it is determined that image data does not exist, the CPU 401 causes the optical scanning unit 104 (image forming apparatus 100) to transition to the standby mode, and if it is determined that image data does exist, the CPU 401 advances the process to step S435.

In step S435, the CPU 401 acquires the temperature of the scanner unit controller 210 that has been measured by the thermistor 410 and stores it in the memory 406 as a temperature measurement value $Tp_2$. Furthermore, in step S436, the CPU 401 obtains a temperature change amount ΔTp by calculating the absolute value of the difference between the temperature measurement values $Tp_1$ and $Tp_2$ as shown in the following equation.

$$\Delta Tp = |Tp_1 - Tp_2| \quad (3)$$

The CPU 401 determines whether or not the calculated temperature change amount ΔTp exceeds a predetermined threshold value. According to this, the CPU 401 determines whether or not the temperature measured by the thermistor 410 has changed by a predetermined amount from the previous BD interval measurement time.

If it is determined in step S436 that the temperature change value ΔTp exceeds the predetermined threshold value, the CPU 401 advances the process to step S437 and executes BD interval measurement (mode 2). Note that in step S437, BD interval measurement can be executed in accordance with a procedure similar to that of Embodiment 2 or 3 (FIG. 20 or 21), for example. Upon completing BD interval measurement in step S437, the CPU 401 returns the process to step S432 and starts image formation on the subsequent recording sheet.

As described above, in the present embodiment, when image formation on multiple recording sheets is to be performed, after starting image formation, each time the temperature measured by the thermistor 410 changes by a predetermined amount, BD interval measurement is executed in a non-image-forming period until image formation on the subsequent recording sheet is started. According to the present embodiment, similarly to Embodiments 2 and 3, the frequency of BD interval measurement can be reduced, and therefore it is possible to further increase the productivity of the image forming apparatus 100 and to extend the lifespan of the light emitting elements used in the BD interval measurement.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-165586, filed Aug. 8, 2013, which is hereby incorporated by reference herein in its entirety.

What is claimed is:

1. An image forming apparatus comprising:

a light source including a plurality of light emitting elements that each emit a light beam;

a deflection unit configured to deflect a plurality of light beams emitted from the plurality of light emitting elements, such that the plurality of light beams scan a photosensitive member;

an optical sensor, that is provided on a scanning path of a light beam deflected by the deflection unit, configured to output a detection signal that indicates that a light beam deflected by the deflection unit has been detected due to the light beam being incident on the optical sensor;

a measurement unit configured to control the light source such that, in a non-image-forming period during which a region other than an image forming region on the photosensitive member is scanned, light beams from first and second light emitting elements among the plurality of light emitting elements are sequentially incident on the optical sensor, and to measure a time interval between two detection signals output sequentially from the optical sensor; and a control unit configured to, in an image forming period during which the image forming region is scanned and which is subsequent to the non-image-forming period, control the light source such that a light beam from the first light emitting element is incident on the optical sensor, and control, using one detection signal output from the optical sensor as a reference, emission times of light beams based on image data for the plurality of light emitting elements, according to a correction value calculated using a measurement value obtained by measurement performed by the measurement unit, wherein when image formation on a plurality of recording mediums is performed, each time image formation on a predetermined number of recording mediums is performed, the measurement unit executes the measurement in the non-image-forming period until image formation on a subsequent recording medium is started, and wherein the correction value is calculated using a current measurement value and a measurement value from a prior time of image formation on the predetermined number of recording mediums.

2. The image forming apparatus according to claim 1, wherein in a non-image-forming period, the measurement unit repeatedly executes the measurement a predetermined number of times and obtains an average value of the measured time intervals as the measurement value.

3. The image forming apparatus according to claim 1, wherein the measurement unit obtains, as the measurement value, an average value of time intervals measured in the measurement in the non-image-forming period and in the measurement in the prior time of image formation on the predetermined number of recording mediums.

4. The image forming apparatus according to claim 1, further comprising:

a temperature sensor configured to measure an internal temperature of the image forming apparatus or a temperature of the light source, wherein when image formation on a plurality of recording mediums is performed, each time the temperature measured by the temperature sensor changes by a predetermined amount after starting image formation on a recording medium, the measurement unit executes the measurement in the non-image-forming period until image formation on a subsequent recording medium is started.

5. The image forming apparatus according to claim 1, further comprising:

a storage unit configured to store in advance a reference value that is to be used as a reference for control performed by the control unit, and timing values indicating the emission times for the plurality of light emitting elements, the timing values being set in association with the reference value, wherein the control unit controls each of the emission times for the plurality of light emitting elements using a value obtained by correcting each of the timing values according to a difference between the time interval measured by the measurement unit and the reference value.

6. The image forming apparatus according to claim 1, wherein the control unit controls a relative delay time, with respect to the one detection signal output from the optical sensor, for each of the emission times of light beams based on image data for the plurality of light emitting elements, according to the measurement value obtained in the measurement performed by the measurement unit.

7. The image forming apparatus according to claim 1, wherein the plurality of light emitting elements are arranged in a linear array in the light source, and the first and second light emitting elements are light emitting elements arranged at both ends of the plurality of light emitting elements.

8. The image forming apparatus according to claim 1, further comprising:

the photosensitive member;

a charging unit configured to charge the photosensitive member; and a developing unit configured to form an image that is to be transferred onto a recording medium on the photosensitive member by developing an electrostatic latent image on the photosensitive member formed by scanning of the plurality of light beams.

9. An image forming apparatus comprising:

a light source including a plurality of light emitting elements that each emit a light beam;

a deflection unit configured to deflect a plurality of light beams emitted from the plurality of light emitting elements, such that the plurality of light beams scan a photosensitive member;

an optical sensor, that is provided on a scanning path of a light beam deflected by the deflection unit, configured to output a detection signal that indicates that a light beam deflected by the deflection unit has been detected due to the light beam being incident on the optical sensor;

a measurement unit configured to control the light source such that, in a non-image-forming period during which a region other than an image forming region on the photosensitive member is scanned, light beams from first and second light emitting elements among the plurality of light emitting elements are sequentially incident on the optical sensor, and to measure a time interval between two detection signals output sequentially from the optical sensor; and a control unit configured to, in an image forming period during which the image forming region is scanned and which is subsequent to the non-image-forming period, control the light source such that a light beam from the first light emitting element is incident on the optical sensor, and control, using one detection signal output from the optical sensor as a reference, emission times of light beams based on image data for the plurality of light emitting elements, according to a measurement value obtained by measurement performed by the measurement unit, wherein when image formation on a plurality of recording mediums is executed, the measurement unit increases an interval between times of executing the measurement, according to a number of accumulated recording mediums on which image formation has been performed.

10. The image forming apparatus according to claim 9, further comprising:

a setting unit configured to, when the measurement is executed by the measurement unit, set a setting value for a number of recording mediums, the setting value indicating a time at which the measurement is to be subsequently executed, wherein in a case where image formation on the number of recording mediums indicated by the setting value is performed after executing the measurement, the measurement unit executes the measurement in the non-image-forming period until image formation on a subsequent recording medium is started, and each time the measurement is executed by the measurement unit, the setting unit changes the setting value to a larger value.

11. The image forming apparatus according to claim 9, wherein the measurement unit repeatedly executes the measurement a predetermined number of times in the non-image-forming period corresponding to a time of executing the measurement and obtains an average value of the measured time intervals as the measurement value.

12. The image forming apparatus according to claim 9, wherein upon reaching a time of executing the measurement, the measurement unit repeatedly executes the measurement a predetermined number of times, by alternatingly repeating the measurement in the non-image-forming period and image formation on a recording medium, and obtains an average value of the measured time intervals as the measurement value.

* * * * *